US008090298B2

(12) United States Patent
Hoshio et al.

(10) Patent No.: US 8,090,298 B2
(45) Date of Patent: Jan. 3, 2012

(54) ELECTROSTATIC CHARGING MEMBER, ELECTROSTATIC CHARGING DEVICE, PROCESS CARTRIDGE AND IMAGE FORMING APPARATUS

(75) Inventors: Takuro Hoshio, Kanagawa (JP); Noboru Wada, Kanagawa (JP); Makoto Takemoto, Kanagawa (JP); Nagahito Ichijo, Kanagawa (JP); Naoki Ohta, Kanagawa (JP); Kenji Inoue, Kanagawa (JP); Hiroyuki Miura, Kanagawa (JP); Keiko Ono, Kanagawa (JP); Taketoshi Hoshizaki, Kanagawa (JP); Minoru Rokutan, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 159 days.

(21) Appl. No.: 12/424,970

(22) Filed: Apr. 16, 2009

(65) Prior Publication Data

US 2010/0104316 A1 Apr. 29, 2010

(30) Foreign Application Priority Data

Oct. 24, 2008 (JP) ..... P2008-274700

(51) Int. Cl.
*G03G 15/02* (2006.01)

(52) U.S. Cl. ..... 399/176

(58) Field of Classification Search ..... 399/100, 399/176, 313; 361/225; 492/53, 56, 59
See application file for complete search history.

(56) References Cited

U.S. PATENT DOCUMENTS

| | | | | |
|---|---|---|---|---|
| 5,112,708 | A * | 5/1992 | Okunuki et al. | 430/31 |
| 7,507,509 | B2 * | 3/2009 | Nagai et al. | 430/58.7 |
| 2010/0247149 | A1 * | 9/2010 | Hoshio | 399/176 |

FOREIGN PATENT DOCUMENTS

| | | | |
|---|---|---|---|
| JP | A-64-66676 | | 3/1989 |
| JP | 05035085 | A * | 2/1993 |
| JP | A-8-137186 | | 5/1996 |
| JP | 08258181 | A * | 10/1996 |
| JP | B2-2649162 | | 5/1997 |
| JP | A-11-7177 | | 1/1999 |
| JP | B2-3024248 | | 1/2000 |
| JP | A-2001-109233 | | 4/2001 |
| JP | 2006184487 | A * | 7/2006 |
| JP | 2006189563 | A * | 7/2006 |
| JP | 2006349708 | A * | 12/2006 |
| JP | 2007047518 | A * | 2/2007 |
| JP | A-2007-225914 | | 9/2007 |
| JP | A-2008-3458 | | 1/2008 |
| JP | 2008089675 | A * | 4/2008 |
| JP | A-2008-209488 | | 9/2008 |

OTHER PUBLICATIONS

Japanese Patent Office, *Notification of Reasons for Refusal for Japanese Patent Application No.* 2008-274700 (with English translation), dated Sep. 14, 2010, pgs. 1-2 (pgs. 1-8 for translation).

* cited by examiner

*Primary Examiner* — Robert Beatty
(74) *Attorney, Agent, or Firm* — Oliff & Berridge, PLC

(57) ABSTRACT

An electrostatic charging member includes a base material; and an outermost layer that contains a porous filler and a resin and has a gel fraction of at least about 50% and a surface roughness Rz in a range of about 2 μm to about 20 μm.

15 Claims, 7 Drawing Sheets

ELECTROSTATIC CHARGING MEMBER, ELECTROSTATIC CHARGING DEVICE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2008-274700 filed on Oct. 24, 2008.

BACKGROUND

1. Technical Field

The present invention relates to an electrostatic charging member, an electrostatic charging device, a process cartridge and an image forming apparatus.

2. Related Art

Image forming apparatuses, notably printers and copiers, have come into widespread use in recent years, and technologies regarding various constituents of such image forming apparatuses have also diffused widely. Of image forming apparatuses, the image forming apparatus adopting electrophotography performs electrostatic charging of an image holding member by use of an electrostatic charging device, and thereby forms electrostatic latent images differing from their surroundings in electric potential on the electrostatically charged image holding member. The thus formed electrostatic latent images are developed with a developer containing toner, and eventually transferred to a recording material. Quite recently, a process cartridge into which constituents of an image forming apparatus, including an image holding member and an electrostatic charging device, are integrated has dominated the market. By incorporating such a process cartridge into an image forming apparatus, the image forming apparatus can be equipped with a plurality of constituents, including an image holding member and an electrostatic charging device, as a single unit, and so maintenance management of the image forming apparatus becomes easy.

Electrostatic charging devices are devices having the function of charging electrostatically image holding members, and roughly classified into two types of charging devices, namely charging devices according to a contact charging method, which are brought into direct contact with image holding members and perform electrostatic charging of the image holding members, and charging devices according to a non-contact charging method, which are not brought into direct contact with image holding members but perform electrostatic charging of the image holding members by generating corona discharge or the like in proximity of the image holding members. In the charging devices according to a non-contact charging method, there may be cases where products such as ozone and nitrogen oxides are evolved secondarily by electric discharge. Therefore, recent years have seen a growth in the number of charging devices adopting the contact charging method.

The electrostatic charging device according to a contact charging method is equipped with an electrostatic charging member such as an electrostatic charging roll, which is brought into direct contact with the surface of an image holding member and made to rotate in synchronization with movement of the image holding member's surface, thereby giving electrostatic charges to the image holding member. The electrostatic charging roll is made up of, e.g., a base material and an elastic conducting layer formed around the peripheral surface of the base material.

SUMMARY

According to an aspect of the invention, there is provided an electrostatic charging member including: a base material; and an outermost layer that contains a porous filler and a resin and has a gel fraction of at least about 50% and a surface roughness Rz in a range of about 2 μm to about 20 μm.

BRIEF DESCRIPTION OF THE DRAWINGS

Exemplary embodiment(s) of the present invention will be described in detail based on the following figures, wherein:

FIG. 11 is a schematic diagram illustrating the configuration of a cleaning roll and an electrostatic charging roll in an electrostatic charging member, wherein

Figure 1:
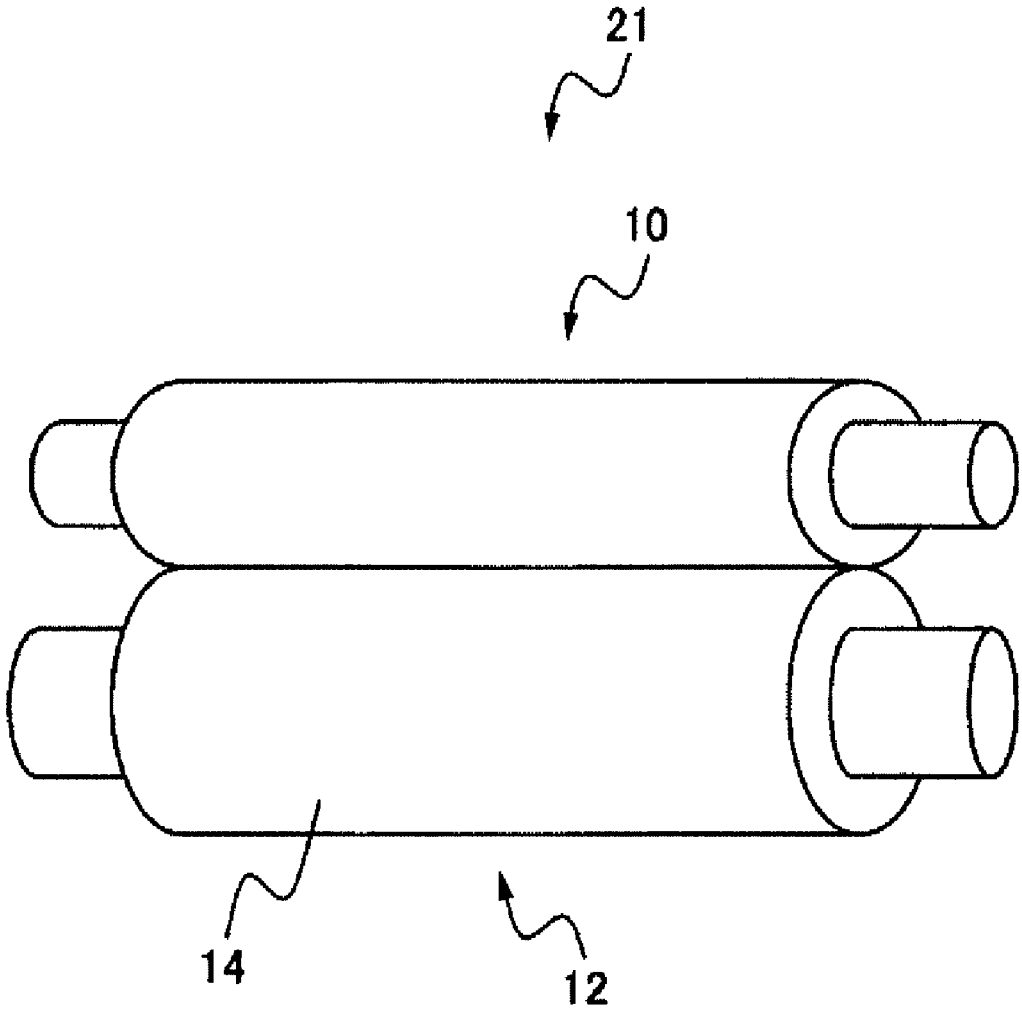
FIG. 1 is a schematic view showing one example of an electrostatic charging device according to an exemplary embodiment of the invention.

1 denotes Electrophotographic photoreceptor, 2 denotes Conductive substrate, 3 denotes Photoreceptive layer, 4 denotes Subbing Layer, 5 denotes Charge generating layer, 6 denotes Charge transporting layer, 7 denotes Protective layer, 8 denotes Single-layer photosensitive layer, 10 denotes Cleaning roll, 12 denotes Electrostatic charging roll, 14 denotes Outermost layer, 20 denotes Process cartridge, 21 denotes Electrostatic charging device, 25 denotes Developing device, 25Y, 25M, 25C and 25K denote Developing units, 26 denotes Developing roll, 27 denotes Cleaning device, 27*a* denotes Fibrous member, 27*b* denotes Cleaning blade, 29 denotes Fibrous member, 30 denotes Exposure device, 31 denotes Lubricant supplying device, 40 denotes Transfer device, 42 denotes Transfer device, 44 denotes Fixing device, 50 denotes Intermediate transfer member, 51, 53, 55 and 65 denote Rolls, 52 denotes Intermediate transfer belt, 60 denotes Paper tray, 61 denotes Taking-out roll, 63 denotes Roll pair, and 100, 110, 120 and 130 denote Image forming apparatuses.

DETAILED DESCRIPTION

The exemplary embodiments of the invention are described below in detail. These embodiments are examples of a typical mode for carrying out the invention, and they should not be construed as limiting the scope of the invention.

<<Electrostatic Charging Member>>

The electrostatic charging member according to each of exemplary embodiments of the invention is an electrostatic charging member for electrostatically charging the surface of an image holding member installed in an image forming apparatus, and includes a base material and an outermost layer that is provided on the base material and brought into contact with the image holding member.

The shape of the electrostatic charging member according to each of exemplary embodiments of the invention is not limited to particular one, and examples thereof include the shapes of a roll, a belt (tube) and a blade (plate). Of these shapes, the shape of a roll (the so-called charging roll) is preferred over the others.

Each electrostatic charging member has no particular restrictions as to its layer structure so long as it includes at least a base material and an outermost layer provided on the base material. In other words, the outermost layer may be provided directly on the base material, or one or more intermediate layers including an elastic conducting layer may be provided between the base material and the outermost layer.

And the electrostatic charging member according to an exemplary embodiment of the invention is preferably a charging roll which has the shape of a roll and a layer structure that an elastic conducting layer and a surface layer (outermost layer) are provided on the base material surface in order of mention.

On the precondition that one example of the electrostatic charging members according to exemplary embodiments of the invention is an electrostatic charging roll, detailed descriptions of a base material, an elastic conducting layer and an outermost layer are given below. And needless to say, materials constituting these layers may be used similarly in electrostatic charging members of other shapes.

<Base Material>

A base material (conductive substrate) functions as an electrode of an electrostatic charging roll and a supporting member, and may be formed of a conductive material. Examples of a conductive material usable as the base material include metals or alloys, such as aluminum, copper alloys and stainless steel; iron plated with chrome, nickel or the like; and conductive resins.

<Elastic Conducting Layer>

The elastic conducting layer may be formed through the process of dispersing a conductivity-imparting agent into a rubber material. Examples of a rubber material usable therein include isoprene rubber, chloroprene rubber, epichlorohydrin rubber, butyl rubber, polyurethane, silicone rubber, fluorocarbon rubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether terpolymer rubber, ethylene-propylene-diene terpolymer rubber (EPDM), acrylonitrile-butadiene copolymer rubber (NBR), natural rubber and blends of two or more of these rubber materials.

Of the rubber materials recited above, polyurethane, silicone rubber, EPDM, epichlorohydrin-ethylene oxide copolymer rubber, epichlorohydrin-ethylene oxide-allyl glycidyl ether terpolymer rubber, NBR and blends of two or more of these rubber materials are preferred over the others. These rubber materials may be those of either foam or non-foam type.

The conductivity-imparting agent may be either an electronic conductive agent, or an ionic conductive agent, or so on.

Examples of an electronic conductive agent include carbon black, such as KETJEN BLACK or acetylene black; pyrolytic carbon; graphite; various conductive metals and alloys, such as aluminum, copper, nickel and stainless steel; various conductive metal oxides, such as tin oxide, indium oxide, titanium oxide, tin oxide-antimony oxide solid solution and tin oxide-indium oxide solid solution; insulation materials whose surfaces are rendered conductive by treatment; and powders of conductive polymers, such as polypyrrole and polyaniline.

Examples of an ionic conductive agent include ammonium salts, such as tetraethylammonium chloride and lauryltrimethylammonium chloride; and salts of alkali or alkaline-earth metals, such as lithium or magnesium.

These conductivity-imparting agents may be used alone, or as combinations of two or more thereof. The amount of a conductivity-imparting agent added to the elastic conducting layer has no particular limits. However, it is appropriate that the electronic conductive agent as recited above be added in an amount of 1 to 30 parts by weight, preferably 15 to 25 parts by weight, per 100 parts by weight of rubber material. And it is appropriate that the ionic conductive agent as recited above be added in an amount of 0.1 to 5.0 parts by weight, preferably 0.5 to 3.0 parts by weight, per 100 parts by weight of rubber material.

In forming an elastic conducting layer, there are no particular restrictions as to the mixing method and mixing order of various ingredients constituting this layer, including a conductivity-imparting agent, a rubber material and others (e.g., a vulcanizing agent, and a foaming agent added as required). For instance, it is possible to adopt a general method of mixing beforehand all the ingredients by use of a tumbler, a V-blender or the like and subjecting the resulting mixture to homogeneous melt blending by use of an extruder.

<Outermost Layer>

Then, the outermost layer is described. The outermost layer in the electrostatic charging member according to an exemplary embodiment of the invention is a layer containing a porous filler. And the gel fraction in the outermost layer is at least about 50% and the surface roughness Rz of the outermost layer is in a range of about 2 μm to about 20 μm. By satisfying these conditions, the outermost layer can produce improvements in uniformity of electrostatic charging and contamination resistance, and allows the electrostatic charging member to have improved durability and outstanding long-term retention of electrostatic charging capability.

In the outermost layer, a porous filler is contained. By containing a porous filler in the outermost layer, progress in rupture of the outermost layer surface by fatigue associated with long-term use can be retarded, and appearance of cracks in the outermost layer can be inhibited. By inhibiting cracks from appearing in the surface layer, it becomes possible to inhibit image defects from appearing by destabilization of electrostatic charging capability resulting from variations in surface resistance of the electrostatic charging member which are caused by adhesion or deposition of toner or external additives of toner into those cracks. Therefore, uniformity of electrostatic charging is improved and durability of the electrostatic charging member is enhanced. As a result, outstanding long-term retention of electrostatic charging capability is achieved. Herein, "porous" in the term porous filler signifies a filler material whose surface is in a state of having pores measuring ½ or below the diameter of the filler particles in diameter and 0.001 μm or above in dimension of the depth direction. To be "porous" can be ascertained by observation of secondary electron images under FE-SEM (JSM-6700F, made by JEOL Ltd.) set at an acceleration voltage of 5 kV. When the dimension of pores in the depth direction is smaller than 0.001 μm, there is a fear that the durability becomes insufficient.

The gel fraction in the outermost layer is at least about 50%, preferably about 60% or above, and far preferably about 90% or above. By allowing the outermost layer to have a gel fraction of at least 50%, mechanical properties of the outermost layer can be enhanced, and fatigue rupture by long-term use can be inhibited. Therefore, the durability of the electrostatic charging member is improved, and outstanding long-term retention of electrostatic charging capability is achieved. When the gel fraction in the outermost layer is below 50%, fatigue rupture appears by long-term use.

The gel fraction in the outermost layer may be controlled by varying the amount of cross-links through adjustment to the heating temperature, the heating time and so on at the time of formation of the outermost layer. In the outermost layer, it is thought that cross-links are formed not only among prime component molecules themselves, such as polyamide resin molecules, but also between the prime component such as a polyamide resin and at least either a resin as the second component, if it is contained, or the porous filler.

Gel fraction measurement is made on the outermost layer as follows. The outermost layer of the electrostatic charging member is cut away, and the weight thereof is measured. The weight thus measured is taken as the weight of resin before solvent extraction. Thereafter, the outermost layer cut away is immersed in a solvent (methanol in this embodiment of the invention) for 24 hours, and then residual resinous filmy matter is separated off and collected by filtration, and further the weight thereof is measured. The weight thus measured is taken as the weight after extraction. The gel fraction is calculated according to the following expression.

$$\text{Gel fraction}(\%)=((\text{weight after solvent extraction})/(\text{weight of resin before solvent extraction}))\times 100$$

When coating film has a gel fraction, or a crosslinking degree, of at least 50%, the growth of a cross-linked structure in the coating film is on a significantly high level, and the coating film can have satisfactory resistance to cracking.

The surface roughness Rz of the outermost layer is in a range of about 2 μm to about 20 μm, preferably in a range of about 4 μm to about 18 μm, and far preferably in a range of about 8 μm to about 15 μm. By controlling the surface roughness Rz of the outermost layer to the 2- to 20-μm range, the durability of the electrostatic charging member is improved, and outstanding long-term retention of electrostatic charging capability is achieved. When the surface roughness Rz of the outermost layer is smaller than 2 μm, there sometimes occurs reduction in the effect of preventing contaminations with toner, external additives of toner and the like; while, when the Rz is greater than 20 μm, there may be cases where cracks appear on the surface by the long-term use.

The surface roughness Rz (ten-point average roughness) of the outermost layer may be controlled by making adjustments to the particle size and amount of a porous filler added, the thickness of the outermost layer and so on.

The surface roughness Rz (ten-point average roughness) of the outermost layer is determined in accordance with the method defined in JIS B0601 (1994).

The outermost layer of the electrostatic charging member has no particular restrictions on a resin as its constituent, and the resin may be a polyamide resin, an acrylic resin, a urethane resin or so on.

The prime component of the outermost layer is preferably a polyamide resin. The polyamide resin has good contamination resistance because it is less prone to adhesion of toner, external additives and the like. In addition, the polyamide resin resists inducing frictional electrification on contact with an image holding member in an image forming apparatus and positively charging the image folding material. Incidentally, the term "prime component" used herein refers to the component making up at least 50% by weight of resins forming the outermost layer. The percentage of a polyamide resin as this prime component is preferably from 50 to 99% by weight, far preferably from 60 to 99% by weight, with all the resins contained in the outermost layer being taken as 100.

Such a polyamide resin has no particular restrictions, and examples thereof include the polyamide resins described in Osamu Fukumoto, *Handbook of Polyamide Resins,* 8400, THE NIKKAN KOGYO SHIMBUN, LTD. Of those polyamide resins, solvent-soluble polyamide resins, notably polyamide resins soluble in alcohol such as methanol or ethanol, are preferred over the others from the viewpoint of allowing easy formation of the outermost layer by a coating film-forming method such as dip coating.

Examples of a solvent-soluble polyamide resin include alcohol-soluble polyamide resins, such as N-alkoxyalkylated nylons produced by alkoxyalkylation of nylons including nylon homopolymers, such as nylon 6, nylon 11, nylon 12, nylon 6,6 and nylon 6,10, and nylon copolymers each of which is constituted of at least two among the nylons recited above.

Of the alcohol-soluble polyamide resins, N-alkoxymethylated nylons, notably N-methoxymethylated nylons, are preferable to the others from the viewpoint of achieving higher level of excellence in long-term retention of electrostatic charging capability.

The weight-average molecular weight of a polyamide resin is preferably from $1\times10^4$ to lower than $1.0\times10^5$. When the polyamide resin has weight-average molecular weight lower than $1\times10^4$, there may be cases where the film strength is weak; while, when the polyamide resin has weight-average molecular weight of $1.0\times10^5$ or higher, there may be cases where reduction in film uniformity occurs. In point of high ability to disperse a conductivity-imparting agent such as carbon black, it is advantageous for the polyamide resin to have lower weight-average molecular weight so long as the molecular weight is within the range specified above.

Besides containing the prime component resin, the outermost layer preferably contains as the second component resin at least one among a resin group made up of a polyvinyl acetal resin, a polyester resin, a phenol resin, an epoxy resin, a melamine resin and a benzoguanamine resin. Of these resins, a polyvinyl acetal resin is preferred over the others in point of its satisfactory ability to disperse a porous filler. With respect to the proportion of the second component resin to the prime component resin, the percentage of the second component resin is preferably from 0.01 to 50% by weight, far preferably from 0.1 to 40% by weight, with the resins in their entirety being taken as 100.

In the outermost layer, a polyamide resin such as an alcohol-soluble polyamide resin may be made to react with a second component resin by heating or the like to form crosslinks such as three-dimensional cross-links. By doing so, the electrostatic charging member can have improved durability, the surface thereof becomes almost free of image defects resulting from cracks or the like, and the long-term use thereof becomes possible.

Examples of a polyvinyl acetal resin include a polyvinyl butyral resin, a polyvinyl formal resin, and a partially acetylated polyvinyl butyral resin whose butyral moieties are modified in part with formal, acetoacetal or the like.

Examples of a polyester resin include polyester resins containing acid-derived constituent units and alcohol-derived constituent units, which may further contain other constituent units as required.

The polyester resins can be synthesized from acids (dicarboxylic acids) and alcohol compounds (diols). The term "acid-derived constituent unit" as used herein refers to the constituent unit which is an acid before synthesis of polyester resin, and the term "alcohol-derived constituent unit" as used herein refers to the constituent unit which is an alcohol compound before synthesis of polyester resin.

The acid-derived constituent unit is preferably a constituent unit derived from an aliphatic dicarboxylic acid, particularly preferably a straight-chain dicarboxylic acid. Examples of such a dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and lower alkyl esters or acid anhydrides of the acids recited above, but acids from which the constituent units can be derived should not be construed as being limited to those recited above.

In addition to the constituent units derived from aliphatic dicarboxylic acids, it is preferable that the acid-derived constituent units further include other constituent units, such as those derived from dicarboxylic acids having double bonds or those derived from dicarboxylic acids having sulfonic acid groups.

Incidentally, the constituent units derived from dicarboxylic acids having double bonds include constituent units derived from lower alkyl esters or acid anhydrides of dicarboxylic acids having double bonds in addition to the constituent units derived from dicarboxylic acids having double bonds, and the constituent units derived from dicarboxylic acids having sulfonic acid groups include constituent units derived from lower alkyl esters or acid anhydrides of dicarboxylic acids having sulfonic acid groups in addition to the constituent units derived from dicarboxylic acids having sulfonic acid groups.

The dicarboxylic acids having double bonds are preferably dicarboxylic acids such as fumaric acid, maleic acid, 3-hexenedioic acid and 3-octenedioic acid, but not limited to these acids. In addition, examples of these dicarboxylic acids may include their lower alkyl esters and acid anhydrides. Of those acids, fumaric acid and maleic acid are preferred over the others in point of cost and so on.

Examples of an alcohol from which the constituent unit is derived include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol, but they should not be construed as being limited to these diols.

The other constituent units contained as required are, e.g., constituent units derived from diols having double bonds and those derived from diols having sulfonic acid groups.

Examples of a diol having a double bond include 2-butene-1,4-dol, 3-hexene-1,6-diol and 4-octene-1,8-diol.

Examples of a diol having a sulfonic acid group include sodium 1,4-dihydroxybenzene-2-sulfonate, sodium 1,3-dihydroxymethylbenzene-5-sulfonate and sodium 1,4-butanediol-2-sulfonate.

The phenol resins are preferably products from monomers such as monomethylolphenols, dimethylolphenols and trimethylolphenols, which are prepared by reaction of compounds having phenol structures, wherein are included phenol, substituted phenols each having one hydroxyl group (e.g., cresol, xylenol, p-alkylphenol, p-phenylphenol), substituted phenols each having two hydroxyl groups (e.g., catechol, resorcinol, hydroquinone), bisphenols (e.g., bisphenol A, bisphenol Z) and biphenols, with formaldehyde, paraformaldehyde or the like in the presence of an acid or an alkali; mixtures of such monomers; oligomers of such monomers; or mixtures of such monomers and oligomers.

The term "epoxy resin" is intended to include all of monomers, oligomers and polymers having two or more epoxy groups per molecule, and has no particular restrictions as to its molecular weight and molecular structure. And examples thereof include biphenyl epoxy resins, bisphenol epoxy resins, stilbene epoxy resins, phenol novolak epoxy resins, cresol novolak epoxy resins, triphenolmethane epoxy resins, alkyl-modified triphenolmethane epoxy resins, triazine nucleus-containing epoxy resins, dicyclopentanediene-modified phenol epoxy resins and phenolaralkyl epoxy resins (having phenylene or diphenylene structures). These resins may be used alone or as combinations of two or more thereof. Of those epoxy resins, biphenyl epoxy resins, bisphenol epoxy resins, stilbene epoxy resins, phenol novolak epoxy resins, cresol novolak epoxy resins and triphenolmethane epoxy resins are preferable to the others, biphenyl epoxy resins, bisphenol epoxy resins, phenol novolak epoxy resins and cresol novolak epoxy resins are far preferable, and bisphenol epoxy resins are particularly preferred over the others.

Examples of a benzoguanamine resin and a melamine resin include compounds having melamine structures or guanamine structures, for example, compounds represented by the following formulae (A) or (B). The compounds represented by formulae (A) or (B) may be synthesized from, e.g., melamine or guanamine and formaldehyde in accordance with any of the heretofore known methods (see, e.g., *Jikken Kagaku Koza* (Courses in Experimental Chemistry), 4th Ed., vol. 28, p. 430).

(A)

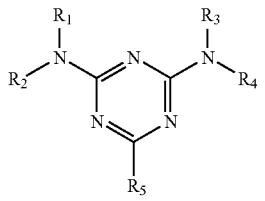

-continued (B)

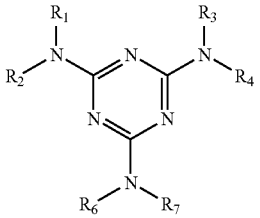

(wherein each of $R_1$ to $R_7$ represents H, $CH_2OH$ or an alkyl ether group.)

In the concrete, the compounds represented by the formula (A) include compounds having the structures (A)-1 to (A)-22 illustrated below and the compounds represented by the formula (B) include compounds having the structures (B)-1 to (B)-6 illustrated below. Each group of these compounds may be used alone, or as mixtures of two or more thereof. Using the compounds in the form of a mixture or an oligomer is preferred, because it can promote organic solvent solubility or main polymer solubility of the compounds.

(A)-1

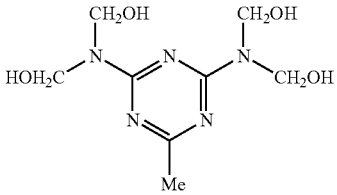

(A)-2

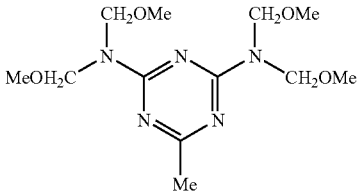

(A)-3

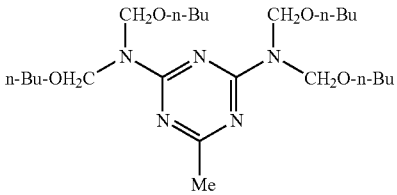

(A)-4

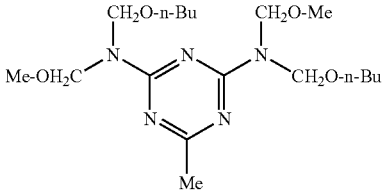

(A)-5

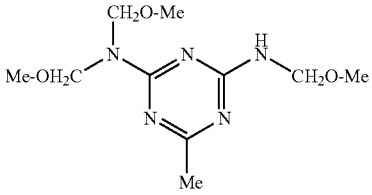

-continued (A)-6

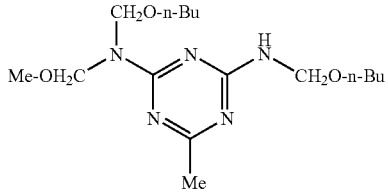

(A)-7

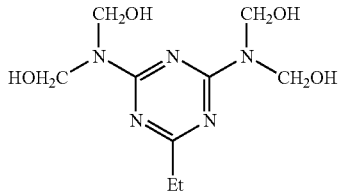

(A)-8

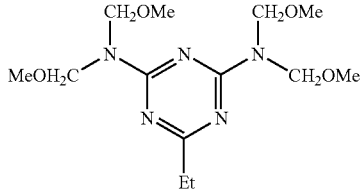

(A)-9

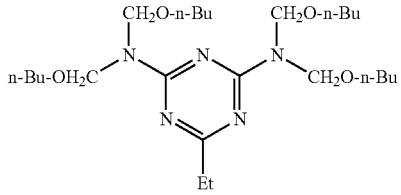

(A)-10

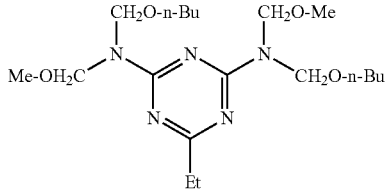

(A)-11

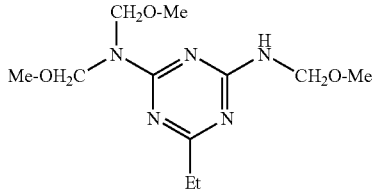

(A)-12

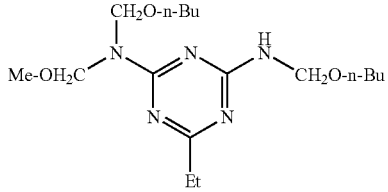

(A)-13

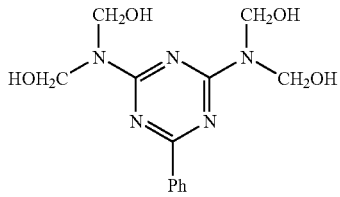

-continued
(A)-14
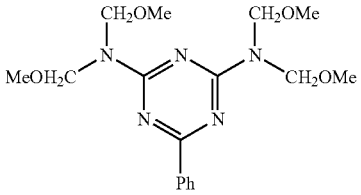
(A)-15
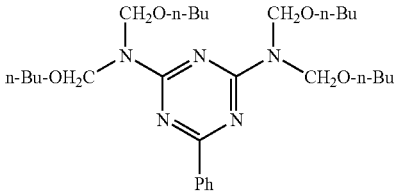
(A)-16
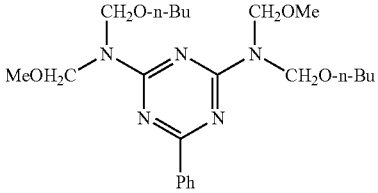
(A)-17
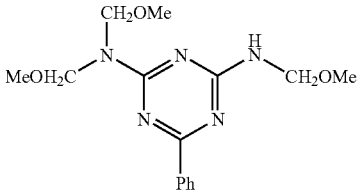
(A)-18
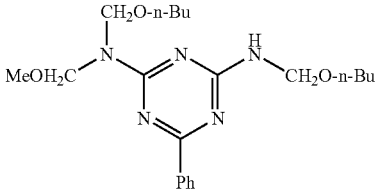
(A)-19
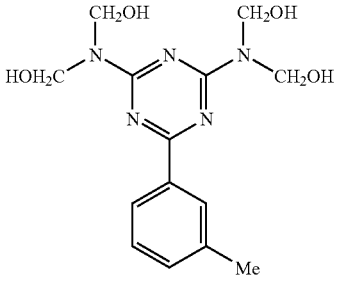
(A)-20
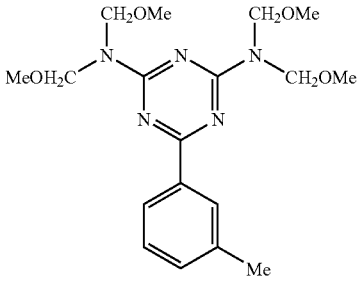
-continued
(A)-21
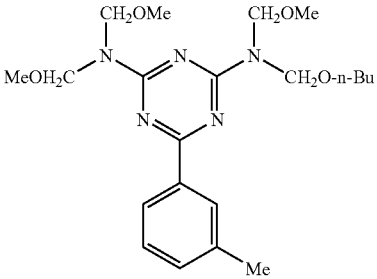
(A)-22
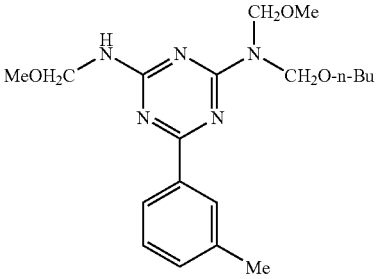
(B)-1
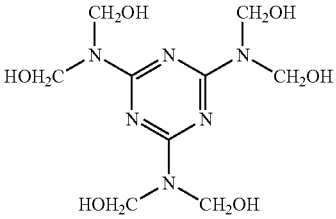
(B)-2
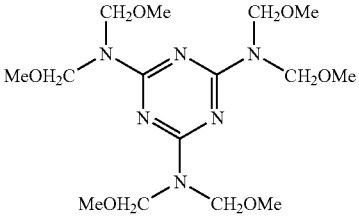
(B)-3
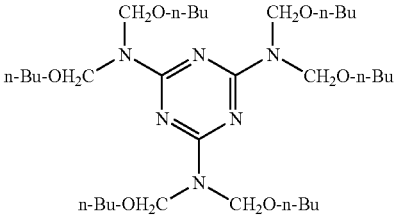
(B)-4
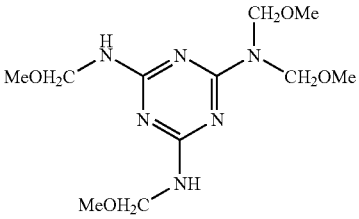

-continued (B)-5

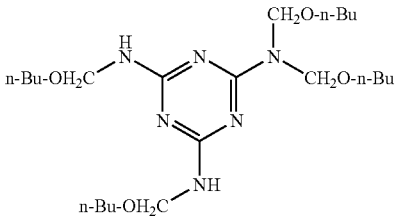

(B)-6

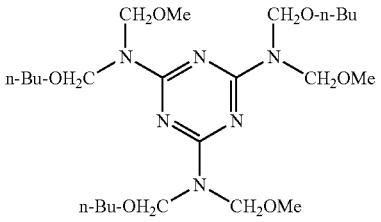

As the melamine resins and the benzoguanamine resins, commercially available products, such as SUPER BECKAMINE (R) L-148-55, SUPER BECKAMINE (R) 13-535, SUPER BECKAMINE (R) L-145-60 and SUPER BECKAMINE (R) TD-126 (products of DIC Corporation), NIKALAC BL-60 and NIKALAC BX-4000 (products of Sanwa Chemical Co., Ltd.), which are all benzoguanamine resins, SUPER MELAMI No. 90 (a product of NOF CORPORATION), SUPER BECKAMINE (R) TD-139-60 (a product of DIC Corporation), U-VAN 2020 (Mitsui Chemicals, Inc.), SUMITEX RESIN M-3 (a product of Sumitomo Chemical Co., Ltd.) and NIKALAC MW-30 and NIKALAC MW-30M (products of Sanwa Chemical Co., Ltd.), may be used as they are.

There is no particular limitation to a porous filler so long as it is a material in the porous state defined hereinbefore, but the porous filler is preferably at least either a polyamide resin, or an acrylic resin, or calcium carbonate.

When the primary component of the outermost layer is a polyamide resin, the porous filler is preferably a polyamide resin in point of its good dispersibility into the resin as the primary component of the outermost layer. When the primary component of the outermost layer is an N-alkoxymethylated nylon, a polyamide resin is also preferred as the porous filler, because there is the possibility that crosslinking reaction will occur between the polyamide resin and the N-alkoxymethylated nylon.

Further, surface treatment may be given to the porous filler. The agent for surface treatment may be chosen from known materials, provided that it can impart the desired property. Examples of an agent usable for the surface treatment include silane coupling agents, titanate coupling agents, aluminate coupling agents and surfactants. Of these agents, silane coupling agents in particular are preferred because of their good adhesion to binder polymers. Further, when the silane coupling agents have amino groups, they can be used to advantage.

The silane coupling agents having amino groups may be any amino group-containing silane compounds so long as they can provide good adhesion to the desired binder polymers. Examples of such a compound include γ-aminopropyltriethoxysilane, N-β-(aminoethyl)-γ-aminopropyltrimethoxysilane, N-β-(aminoethyl)-γ-aminopropylmethyldimethoxysilane and N,N-bis(β-hydroxyethyl)-γ-aminopropyltriethoxysilane, but should not be construed as being limited to these compounds.

The silane coupling agents may be used as mixtures of two or more thereof. Examples of silane coupling agents which may be used in combination with the amino group-containing silane coupling agents as recited above include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane and γ-choropropyltrimethoxysilane, but should not be construed as being limited to these silanes.

The method for the surface treatment may be any of known methods. For instance, either a wet method or a dry method may be employed. As to the proportion of the porous filler to the resins in the outermost layer, the porous filler content is preferably from 1 to 100% by weight, far preferably from 3 to 80% by weight, with the resins in their entirety being taken as 100.

The outermost layer preferably contains a conductivity-imparting agent. By incorporating such an agent into the outermost layer, resistance control of the outermost layer becomes easy.

Examples of a conductivity-imparting agent include the same conductivity-imparting agents as the elastic conducting layer can contain, such as electronic conductive agents and ionic conductive agents. Of these agents, at least either a conductive polymer, or carbon black, or tin oxide is used to advantage as the conductivity-imparting agent in point of evenness in resistance and so on.

These conductivity-imparting agents may be used alone, or as combinations of two or more thereof. There is no particular limits for the amount of a conductivity-imparting agent added to the outermost layer. However, the suitable addition amount of an electronic conductive agent is from 1 to 50 parts by weight, preferably from 3 to 30 parts by weight, per 100 parts by weight of the primary component of the outermost layer. And the suitable addition amount of an ionic conductive agent is also from 1 to 50 parts by weight, preferably from 3 to 30 parts by weight, per 100 parts by weight of the primary component of the outermost layer.

The outermost layer is formed in accordance with, e.g., the method of coating the surface of, say, an elastic conducting layer with a curing resin composition containing a primary component resin and a porous filler, and further a second component resin, a conductivity-imparting agent and so on as required, and drying the coated composition by heating. By such a heating operation, crosslinking reaction occurs in the outermost layer. The outermost layer is preferably a layer having undergone crosslinking in the presence of a catalyst for the purpose of promoting the curing (crosslinking) by drying under heating. As the catalyst, an acid catalyst or the like may be used.

Examples of an acid catalyst usable for the foregoing purpose include aliphatic carboxylic acids, such as acetic acid, chloroacetic acid, trichloroacetic acid, trifluoroacetic acid, oxalic acid, maleic acid, malonic acid, lactic acid and citric acid; aromatic carboxylic acids, such as benzoic acid, phthalic acid, terephthalic acid and trimellitic acid; aliphatic and aromatic sulfonic acids, such as methanesulfonic acid, dodecylsulfonic acid, benzenesulfonic acid, dodecylbenzenesulfonic acid, naphthalenesulfonic acid, p-toluenesulfonic acid, dinonylnaphthalenesulfonic acid (DNNSA), dinonylnaphthalenedisulfonic acid (DNNDSA) and phenolsulfonic acid; and phosphoric acid. Of these acids, p-toluenesulfonic acid, dodecylbenzenesulfonic acid and phosphoric acid are preferred over the others in terms of catalytic power, film formation and so on.

By using an acid catalyst capable of exhibiting an increase in catalytic power upon heating up to a specific temperature, or the so-called thermally-latent catalyst, the curing resin composition can have low catalytic power at its storage temperature, while it can have high catalytic power under curing. Thus, curing temperature reduction and storage stability (dispersion stability) of the curing resin composition are compatible with each other.

Examples of a thermally-latent catalyst include microcapsules which are made of a polymer and enclose an organic sulfone compound or the like into a particle form, an acid adsorbed to a porous compound such as zeolite, a thermally-latent proton acid catalyst obtained by blocking at least one of proton acids and proton acid derivatives with a base, a product obtained by esterification of at least one of proton acids and proton acid derivatives with a primary or secondary alcohol, a catalyst obtained by blocking at least one of proton acids and proton acid derivatives with at least one of vinyl ethers and vinyl thioethers, monoethylamine complex of boron trifluoride, and pyridine complex of boron trifluoride.

Of these catalysts, a thermally-latent proton acid catalyst obtained by blocking at least one of proton acids and proton acid derivatives with a base is preferred over the others in terms of catalytic power, storage stability, availability, cost and so on.

Examples of a proton acid from which a thermally-latent proton acid catalyst is produced include sulfuric acid, hydrochloric acid, acetic acid, formic acid, nitric acid, phosphoric acid, sulfonic acid, monocarboxylic acid, polycarboxylic acid, propionic acid, oxalic acid, benzoic acid, acrylic acid, methacrylic acid, itaconic acid, phthalic acid, maleic acid, benzenesulfonic acid, o-toluenesulfonic acid, m-toluenesulfonic acid, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid and dodecylbenzenesulfonic acid. Examples of a proton acid derivatives usable in producing a thermally-latent acid catalyst include neutralization products such as alkali metal salts or alkaline earth metal salts of proton acids including sulfonic acid and phosphoric acid, and polymer compounds having proton acid structures in their respective polymer chains (such as polyvinylsulfonic acid). Examples of a base usable for blocking proton acids include amines.

Such amines have no particular restrictions, and any of primary, secondary and tertiary amines may be used.

Examples of a primary amine include methylamine, ethylamine, propylamine, isopropylamine, n-butylamine, isobutylamine, t-butylamine, hexylamine, 2-ethylhexylamine, sec-butylamine, allylamine and methylhexylamine.

Examples of a secondary amine include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di-sec-butylamine, diallylamine, N-methylhexylamine, 3-pipecoline, 4-pipecoline, 2,4-lupetidine, 2,6-lupetidine, 3,5-lupetidine, morpholine and N-methylbenzylamine.

Examples of a tertiary amine include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpyridine, pyridine, 4-ethylpyridine, N-propyldiallylamine, 3-dimethlaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole and N-methylpiperazine.

Commercially produced thermally-latent catalysts may be used in the invention also. Examples of such catalysts sold on the market include the products of King Industries Inc., such as NACURE 2501 (acid to be dissociated: toluenesulfonic acid, solvent: methanol/propanol mixture, pH: 6.0-7.2, dissociation temperature: 80° C.), NACURE 2107 (acid to be dissociated: p-toluenesulfonic acid, solvent: isopropanol, pH: 8.0-9.0, dissociation temperature: 90° C.), NACURE 2500 (acid to be dissociated: p-toluenesulfonic acid, solvent: isopropanol, pH: 6.0-7.0, dissociation temperature: 65° C.), NACURE 2530 (acid to be dissociated: p-toluenesulfonic acid, solvent: methanol/isopropanol mixture, pH: 5.7-6.5, dissociation temperature: 65° C.), NACURE 2547 (acid to be dissociated: p-toluenesulfonic acid, solvent: water, pH: 8.0-9.0, dissociation temperature: 107° C.), NACURE 2558 (acid to be dissociated: p-toluenesulfonic acid, solvent: ethylene glycol, pH: 3.5-4.5, dissociation temperature: 80° C.), NACURE XP-357 (acid to be dissociated: p-toluenesulfonic acid, solvent: methanol, pH: 2.0-4.0, dissociation temperature: 65° C.), NACURE XP-386 (acid to be dissociated: p-toluenesulfonic acid, solvent: water, pH: 6.1-6.4, dissociation temperature: 80° C.), NACURE XC-2211 (acid to be dissociated: p-toluenesulfonic acid, pH: 7.2-8.5, dissociation temperature: 80° C.), NACURE 5225 (acid to be dissociated: dodecylbenzenesulfonic acid, solvent: isopropanol, pH: 6.0-7.0, dissociation temperature: 120° C.), NACURE 5414 (acid to be dissociated: dodecylbenzenesulfonic acid, solvent: xylene, dissociation temperature: 120° C.), NACURE 5228 (acid to be dissociated: dodecylbenzenesulfonic acid, solvent: isopropanol, pH: 7.0-8.0, dissociation temperature: 120° C.), NACURE E-5925 (acid to be dissociated: dodecylbenzenesulfonic acid, pH: 7.0-7.5, dissociation temperature: 130° C.), NACURE 1323 (acid to be dissociated: dinonylnaphthalenesulfonic acid, solvent: xylene, pH: 6.8-7.5, dissociation temperature: 150° C.), NACURE 1419 (acid to be dissociated: dinonylnaphthalenesulfonic acid, solvent: xylene/methyl isobutyl ketone mixture, dissociation temperature: 150° C.), NACURE 1557 (acid to be dissociated: dinonylnaphthalenesulfonic acid, solvent: butanol/2-butoxyethanol mixture, pH: 6.5-7.5, dissociation temperature: 150° C.), NACURE X49-110 (acid to be dissociated: dinonylnaphthalenedisulfonic acid, solvent: isobutanol/isopropanol mixture, pH: 6.5-7.5, dissociation temperature: 90° C.), NACURE 3525 (acid to be dissociated: dinonylnaphthalenedisulfonic acid, solvent: isobutanol/isopropanol mixture, pH: 7.0-8.5, dissociation temperature: 120° C.), NACURE XP-383 (acid to be dissociated: dinonylnaphthalenedisulfonic acid, solvent: xylene, dissociation temperature: 120° C.), NACURE 3327 (acid to be dissociated: dinonylnaphthalenedisulfonic acid, solvent: isobutanol/isopropanol mixture, pH: 6.5-7.5, dissociation temperature: 150° C.), NACURE 4167 (acid to be dissociated: phosphoric acid, solvent: isopropanol/isobutanol mixture, pH: 6.8-7.3, dissociation temperature: 80° C.), NACURE XP-297 (acid to be dissociated: phosphoric acid, solvent: water/isopropanol mixture, pH: 6.5-7.5, dissociation temperature: 90° C.) and NACURE 4575 (acid to be dissociated: phosphoric acid, pH: 7.0-8.0, dissociation temperature: 110° C.).

These thermally-latent catalysts may be used alone or as combinations of two or more thereof.

The mixing amount of thermally-latent catalyst(s) is preferably from 0.01% to 20% by weight, far preferably from 0.1% to 10% by weight, based on 100 parts by weight of solids in the curing resin composition solution. Mixing amounts of catalyst(s) greater than 20% by weight may cause precipitation of the catalyst(s) as extraneous matter after heat treatment, while mixing amounts smaller than 0.01% by weight may result in shortage of catalytic activity.

In view of durability to withstand wearing with use of the electrostatic charging member, the greater thickness the outermost layer has the better. However, there may be cases where too great thickness causes a degradation in capability of charging an image holding member, so it is appropriate that the thickness be from 0.01 μm to 1,000 μm, preferably from 0.1 μm to 500 μm, and far preferably from 0.5 μm to 100 μm.

The outermost layer may be formed on a supporting member by use of a dip coating method, a spray coating method, a vacuum evaporation method or a plasma method. Of these method, a dip coating method has an advantage over the others in point of easiness of layer formation.

<Cleaning Member>

A cleaning member for cleaning the outer surface of the electrostatic charging member has a core material and an elastic layer provided on the periphery of the core material, and the elastic layer is preferably formed in a state of incorporating a foam material. Further, the cleaning member may have a coating layer formed by coating of such an elastic layer. Between the core material and the elastic layer, an interlayer using a hot melt adhesive, an elastic layer and so on may be provided as required.

The use of a foam material having a surface coating allows not only retention of advantages from using a contact charging member, notably a charging roller, but also avoidance of charging roller contaminations with adhesion of toner, paper powder and other extraneous matter, and further allows prevention of image defects traceable to the contaminations, such as bleed and blur of images. Furthermore, the use of such a foam material makes it possible to impart conductivity to the cleaning member, to retain good charging function without occurrence of distortion at nip-time, and what's more, to prevent damage to a charging roller and an image holding member.

The shape of a cleaning member relating to an exemplary embodiment of the invention is not limited to a particular one, and it may be any of roll, brush, pad (plate) and like shapes. Of these shapes, the shape of a roll (the so-called cleaning roll) is preferred over the others, because the cleaning member in the shape of a roll imposes less stress on the electrostatic charging member. However, even when the cleaning member in the shape of a pad (plate), which imposes more stress on an electrostatic charging member, is used, and that for the long term, images defects traceable to cracks or the like on the surface of the electrostatic charging member can be reduced as long as the electrostatic charging member according to an exemplary embodiment of the invention is used. So, the cost of a cleaning member can be reduced.

Next, structural components of the cleaning member are described.

A core material of the cleaning member is described first. In general, a molded article of iron, copper, brass, stainless steel, aluminum, nickel or the like may be used as the core material. Alternatively, a molded article of resin which contains conductive particles in a dispersed state may be used as the core material.

As an elastic material from which an elastic layer is formed, any material may be used as long as the desired properties can be obtained thereby. Examples of an elastic material include foam materials produced respectively from a polyurethane resin, a polystyrene resin, a polyethylene resin, a polypropylene resin, a nylon resin, a melamine resin, a polyethylene terephthalate resin, an ethylene-vinyl acetate copolymer, butyl rubber, nitrile rubber, polyisoprene rubber, polybutadiene rubber, silicone rubber, natural rubber, ethylene-propylene rubber, ethylene-propylene-diene rubber, styrene-butadiene rubber, acrylic rubber and chloroprene rubber. Of these foam materials, polyurethane foam is especially preferred over the others.

The polyurethane foam which constitutes the elastic layer is produced using, e.g., at least a polyol, a foaming control agent and a reaction catalyst.

Examples of a polyol usable therein include polyoxypropylene glycol, polyoxytetramethylene glycol, polyester polyol, polycaprolactone polyol and polycarbonate polyol. These polyols may be used alone or as mixtures of two or more thereof.

In addition, an isocyanate may be used for forming crosslinks between molecules of a polyol. Examples of an isocyanate usable for crosslinking include tolylene diisocyanate, diphenylmethane diisocyanate, naphthalene diisocyanate, tolidine diisocyanate, isophorone diisocyanate, hexamethylene diisocyanate, xylylene diisocyanate, hydrogenated xylene diisocyanate, hydrogenated diphenylmethane diisocyanate, triisocyanate, tetramethylxylene diisocyanate, lysine ester triisocyanate, lysine diisocyanate, trimethylhexamethylene diisocyanate, dimer acid diisocyanate and norbornene diisocyanate. These isocyanates may be used alone or as combinations of two or more thereof.

Examples of a reaction catalyst usable therein include amine catalysts, such as triethylamine, tetramethylethylene diamine, triethylene diamine (TEDA), bis(N,N-dimethylamino-2-ethyl)ether, N,N,N'N'-tetramethylhexamethylene diamine and bis(2-dimethylaminoethyl)ether (TOYOCAT-ET, a product of TOSOH CORPORATION), metal salts of carboxylic acids such as potassium acetate and potassium octylic acid, and organometallic compounds such as dibutyltin laurate. Of these catalysts, amine catalysts are used to advantage in point of their suitability for water-foamable polyurethane foam production. These reaction catalysts may be used alone or as mixtures of two or more thereof.

Examples of a foaming control agent usable therein include silicone surfactants such as dimethylsilicone oil and polyether-modified silicone oil, cationic surfactants, anionic surfactants and amphoteric surfactants.

The amount of a catalyst used is preferably from 0.01% to 5% by weight, far preferably from 0.05% to 3% by weight, and further preferably from 0.1% to 1% by weight, with respect to the total amount of polyol and isocyanate. When no catalyst is used, there may be cases where image defects appear by exudation of unreacted polymer remaining in the cleaning roll to the interface between the cleaning roll and the electrostatic charging member.

Then, other ingredients to be mixed are described. One of other ingredients to be mixed is a conductive agent. Examples of the conductive agent include carbon conductive agents, such as KETJEN BLACK, acetylene black, oil furnace black and thermal black, and ionic conductive agents including ammonium compounds, such as tetraethyl ammonium and stearyltrimethylammonium chloride.

Additives, such as a fire retardant, a deterioration inhibitor and a plasticizer, may be included in the other ingredients to be mixed. These other ingredients to be mixed may be used alone, or as combinations of two or more thereof. And these additives may also be used alone, or two or more of them may be used together.

As to the form of a foam material in an exemplary embodiment of the invention, the cell number of foam cells (per 25 mm) is preferably from 20 to 200. When the cell number is lower than 20 or higher than 200, the resultant cleaning roll may fail in delivering satisfactory cleaning power to the electrostatic charging member.

Manufacturing methods for a polyurethane foam are described below. The polyurethane foam has no particular limitations to its manufacturing method, and may be manufactured by general methods. One example of the manufacturing method is as follows. Raw materials including polyurethane polyol, a foaming control agent and a catalyst, and further a conductive agent and so on as required, are mixed first, and then they are heated to undergo reaction and curing, thereby producing a polyurethane foam.

At the time of mixing such raw materials, the mixing temperature and time have no particular limits. However, the mixing temperature is generally in a range of 10° C. to 90° C., preferably in a range of 20° C. to 60° C., and the mixing time is generally from 10 seconds to 20 minutes, preferably from 30 seconds to 5 minutes. When the reaction and curing are caused by heating, foaming operation is carried out using any of the heretofore known methods to yield polyurethane foam.

Herein, the foaming operation is not particularly restricted as to its method, and any of methods including a method of using a foaming agent and a method of mixing bubbles by mechanical agitation may be employed.

Next, manufacturing methods of the cleaning member are described. Examples of a manufacturing method for a cleaning roll include a method of forming a polyurethane foam of a desired shape by injecting raw materials into a mold and foaming them, and coating a core material with the polyurethane foam; and a method of carrying out slab casting of a polyurethane foam, and working the polyurethane foam into the desired shape by grinding, and then coating a core material with the thus worked polyurethane foam.

<Electrostatic Charging Device>

FIG. 1 is a schematic structural view showing an example of an electrostatic charging device according to an exemplary embodiment of the invention. The electrostatic charging device 21 has an electrostatic charging roll 12 for electrostatic charging of an electrostatic charge-receiving member (e.g., an image holding member) and a cleaning roll 10 placed in contact with the peripheral surface of the charging roll 12. As the electrostatic charging roll 12, an electrostatic charging roll having the outermost layer 14 specified above is employed.

The peripheral surface (elastic layer surface) of the cleaning roll 10 is brought into contact with the outermost layer 14 of the electrostatic charging roll 12 in a freely disjunctive state. Further, the cleaning roll 10 may be placed to have freedom of to-and-fro movements in the axial direction of the electrostatic charging roll 12. By doing so, it becomes possible to keep the cleaning roll 10 in separation from the electrostatic charging roll 12 when no cleaning is required (for instance, an image forming apparatus is in a long-term non-operational state), and to ensure substantially uniform cleaning of the surface of the electrostatic charging roll 12.

The cleaning roll 10 is installed in a state of pressing the electrostatic charging roll 12 when brought into contact with the electrostatic charging roll 12, and thereby it is set in a rotary motion following the rotation of the electrostatic charging roll 12. By doing so, scratches and the like on the electrostatic charging roll 12 can be prevented from occurring.

The electrostatic charging device 21 performs electrostatic charging of an electrostatic charge-receiving member (e.g., an image holding member) by means of the electrostatic charging roll 12 as the surface of the electrostatic charging roll 12 is cleaned with the cleaning roll 10.

By employing the electrostatic charging roll specified above, occurrence of cracks on the outermost layer is reduced, and image defects resulting from destabilized charging capability ascribed to variations caused in surface resistance of the electrostatic charging member by, say, adhesion or deposition of toner, external additives of toner and the like onto those cracks can be prevented from appearing. In addition, the durability of the surface of the electrostatic charging roll 12 is high, so the strength to press the cleaning roll 10 against the electrostatic charging roll 12 can be heightened and thereby satisfactory cleaning of the electrostatic charging roll 12 can be achieved.

<Image Forming Apparatus and Process Cartridge>

Figure 2:
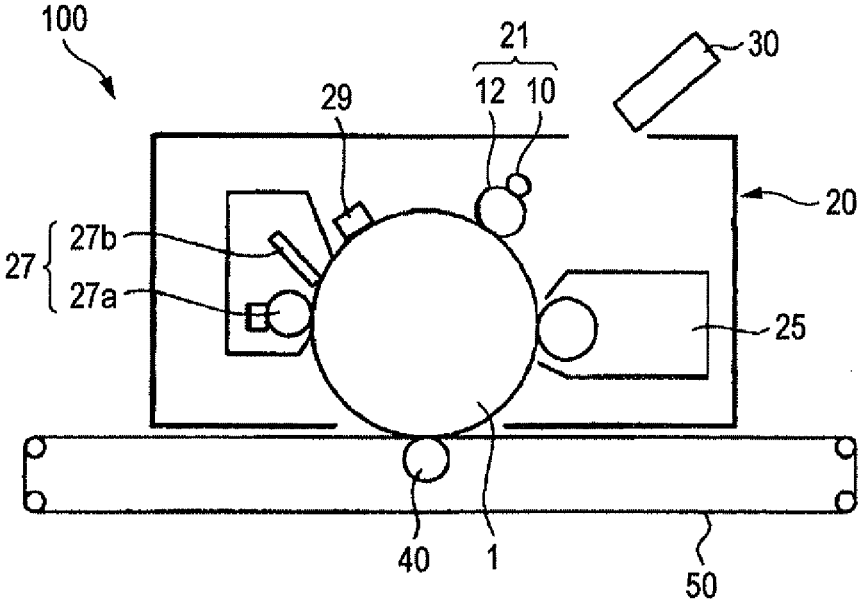
FIG. 2 is a schematic diagram illustrating one example of an image forming apparatus according to an exemplary embodiment of the invention.

FIG. 2 is a schematic diagram illustrating one example of an image forming apparatus according to an exemplary embodiment of the invention. The image forming apparatus 100 illustrated in FIG. 2 has in its body (not shown in the figure) a process cartridge 20 equipped with at least an electrostatic charging device 21, an exposure device 30 as a latent-image forming unit, a transfer device 40 as a transfer unit, and an intermediate transfer member 50. In the image forming apparatus 100, the exposure device 30 is placed in a position to allow exposure of an electrophotographic photoreceptor 1 (an image holding member) to light through an opening of the process cartridge 20, the transfer device 40 is placed to face the electrophotographic photoreceptor 1 via an intermediate transfer member 50, and the intermediate transfer member 50 is placed in a position allowing part of the member 50 to come into contact with the electrophotographic photoreceptor 1.

The process cartridge 20 contains the electrostatic charging device 21, the electrophotographic photoreceptor 1, a developing device 25 as a unit for development, a cleaning device 27 and a fibrous member (in a flat-brush form) 29 which are built into the cartridge case and assembled with a mounting rail into one unit. Incidentally, the case has an opening for light exposure.

And the electrostatic charging device shown in FIG. 1 is employed as the electrostatic charging device 21. By the way, the electrostatic charging device 21 is made up of the electrostatic charging roll 12 and the cleaning roll 10.

Figure 11:
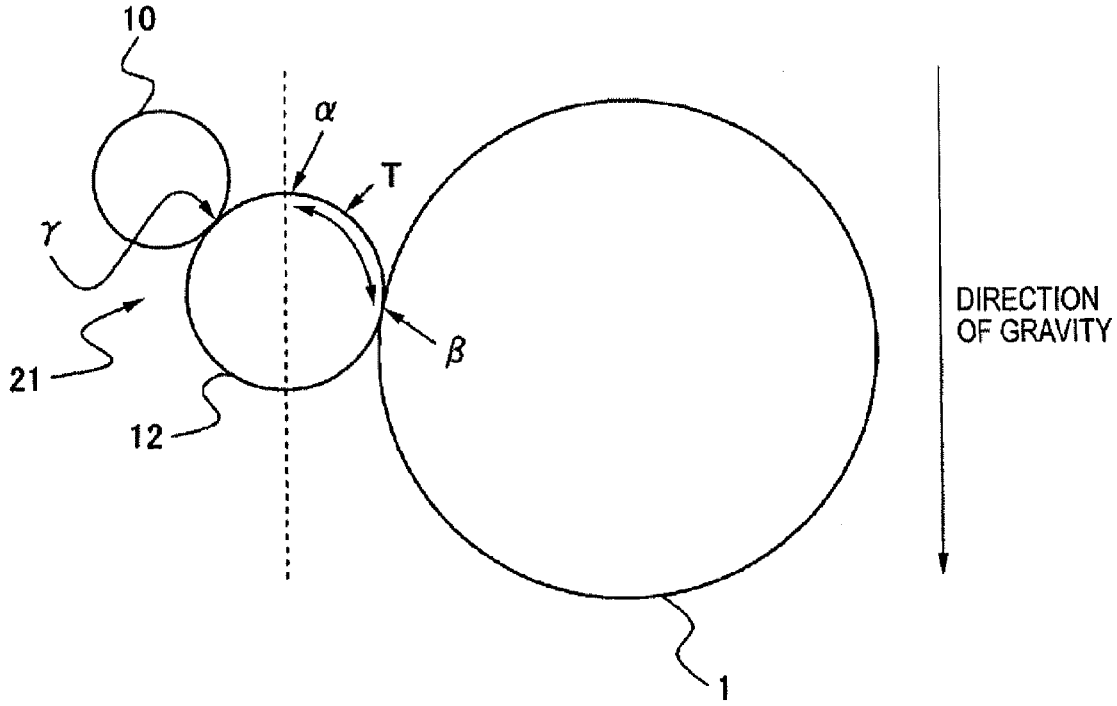

Herein, it is preferred that the cleaning roll 10 be placed in contact with the electrostatic charging roll 12 under the following conditions. As shown in FIG. 11, in the cross section orthogonal to each of axes of the electrostatic charging roll 12, the cleaning roll 10 and the electrophotographic photoreceptor 1, when one position, which is located on the upper side than the axis point of the electrostatic charging roll 12 with respect to the direction of gravity, of the two positions at which the line (the dotted line in FIG. 11) passing through the axis point of the electrostatic charging roll 12 and being parallel to the direction of gravity is intersected with the periphery of the electrostatic charging roll 12 is taken as $\alpha$ and the contact position between the electrostatic charging roll 12 and the electrophotographic photoreceptor 1 is taken as $\beta$, it is preferable that the cleaning roll 10 is placed so that the contact portion $\gamma$ between the cleaning roll 10 and the electrostatic charging roll 12 is located in a position other than the peripheral region T of the electrostatic charging roll 12 which is sandwiched between the position $\alpha$ and the position $\beta$ and situated toward the placement side of the electrophotographic photoreceptor 1 with respect to the axis point of the electrostatic charging roll 12.

By placing the cleaning roll 10 in such a configuration, extraneous matter coming off the cleaning roll 10 is prevented from falling to the electrostatic charging roll 12 and the electrophotographic photoreceptor 1. As a result, charging failure by the extraneous matter is prevented from occurring on the electrophotographic photoreceptor 1, occurrence of color spots detrimental to image quality is avoided, and impairment of image quality is prevented over the long term.

Figure 6:
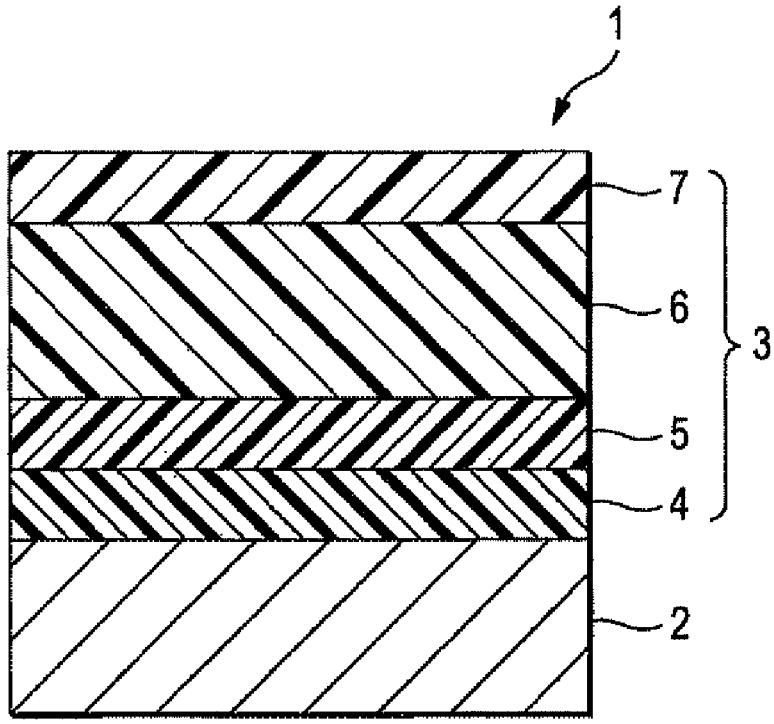
FIG. 6 is a cross-sectional view showing one example of electrophotographic photoreceptors used in exemplary embodiments of the invention.

Next the electrophotographic photoreceptor 1 is described. FIG. 6 is a cross-sectional view showing one example of an electrophotographic photoreceptor usable in the image forming apparatus according to an exemplary embodiment of the invention. The electrophotographic photoreceptor 1 shown in FIG. 6 is made up of a conductive substrate 2 and a photoreceptive layer 3. The photoreceptive layer 3 has a multilayer structure formed by stacking on the conductive substrate 2 a subbing layer 4, a charge generating layer 5, a charge transporting layer 6 and a protective layer 7 in order of mention.

Figure 7:
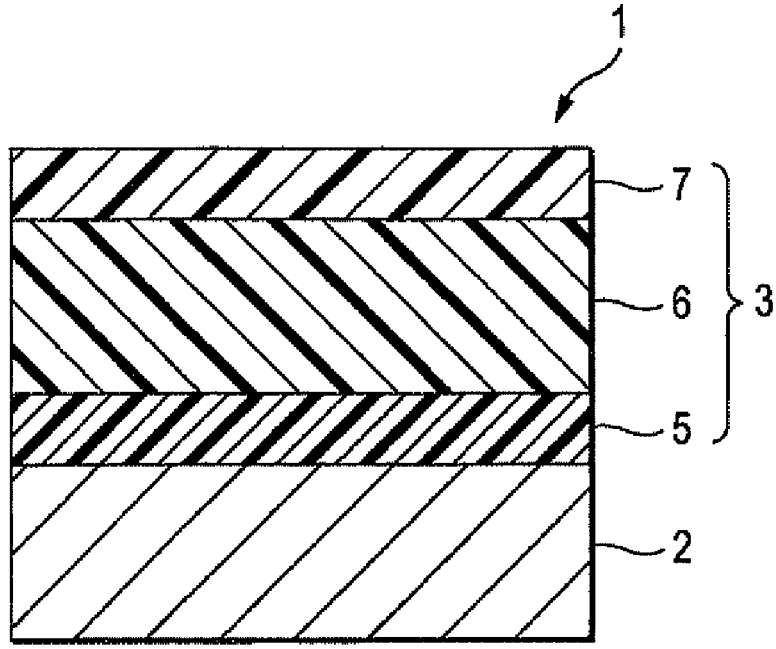
FIG. 7 is a cross-sectional view showing another example of electrophotographic photoreceptors used in exemplary embodiments of the invention.
Figure 8:
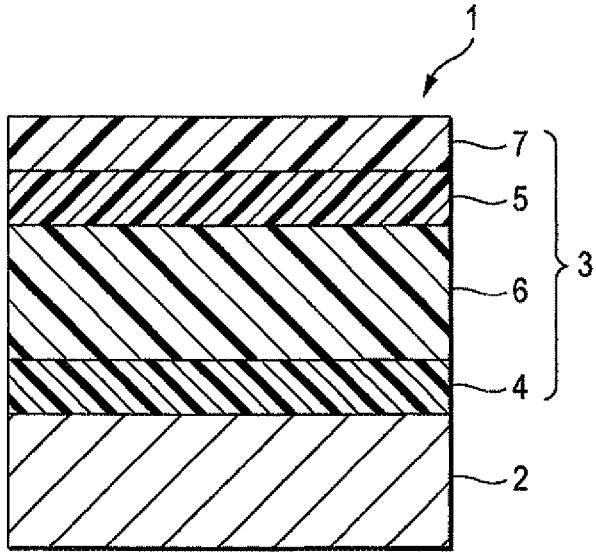
FIG. 8 is a cross-sectional view showing still another example of electrophotographic photoreceptors used in exemplary embodiments of the invention.
Figure 9:
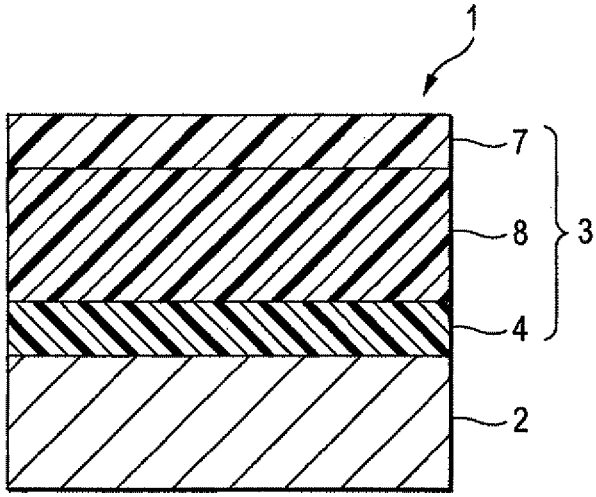
FIG. 9 is a cross-sectional view showing a further example of electrophotographic photoreceptors used in exemplary embodiments of the invention.
Figure 10:
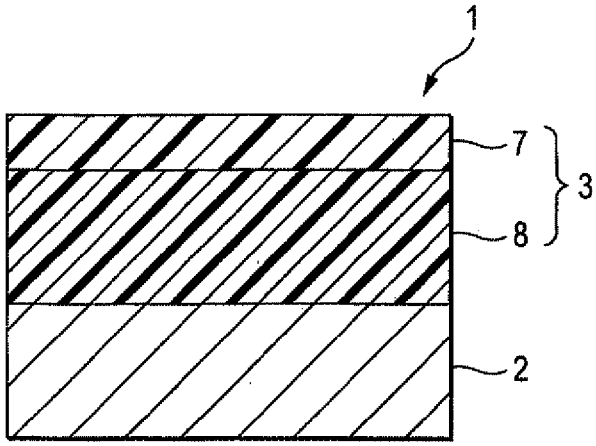
FIG. 10 is a cross-sectional view showing a still further example of electrophotographic photoreceptors used in exemplary embodiments of the invention.

And FIG. 7 to FIG. 10 are schematic cross-sectional views showing other examples of the electrophotographic photoreceptor, respectively. The electrophotographic photoreceptors shown in FIG. 7 and FIG. 8 are each provided with a photoreceptive layer 3 whose function is divided between the charge generating layer 5 and the charge transporting layer 6 as in the case of the electrophotographic photoreceptor shown in FIG. 6. On the other hand, those shown in FIG. 9 and FIG. 10 are each provided with a photoreceptive layer (single-layer photoreceptive layer 8) containing both a charge generating material and a charge transporting material.

The electrophotographic photoreceptor 1 shown in FIG. 7 has a multilayer structure that a charge generating layer 5, a charge transporting 6 and a protective layer 7 are stacked on a conductive substrate 2 in order of mention. And the electrophotographic photoreceptor 1 shown in FIG. 8 has a multilayer structure that a subbing layer 4, a charge transporting 6, a charge generating layer 5 and a protective layer 7 are stacked on a conductive substrate 2 in order of mention.

On the other hand, the electrophotographic photoreceptor 1 shown in FIG. 9 has a multilayer structure that a subbing layer 4, a single-layer photoreceptive layer 8 and a protective layer 7 are stacked on a conductive substrate 2 in order of mention. And the electrophotographic photoreceptor 1 shown in FIG. 10 has a multilayer structure that a single-layer photoreceptive layer 8 and a protective layer 7 are stacked on a conductive substrate 2 in order of mention.

Incidentally, a subbing layer 4 necessarily needn't be provided in each of electrophotographic photoreceptors shown in FIG. 6 to FIG. 10.

The photoreceptive layer included in the electrophotographic photoreceptor 1 may be either a single-layer photoreceptive layer that both a charge generating layer and a charge transporting layer are contained in one and the same layer, or a function-division photoreceptive layer that a layer containing a charge generating material (charge generating layer) and a layer containing a charge transporting material (charge transporting layer) are provided independently. As to the arranging order of constituent layers in a function-division photoreceptive layer, either a charge generating layer or a charge transporting layer may be the upper layer. Making an additional remark, the function-division photoreceptive layer can achieve higher performance since the division of function is made between constituent layers so that each individual constituent layer may satisfy a single-function allocated thereto.

Although the electrophotographic photoreceptor 1 is not limited to a particular one and any of known ones may be employed, components thereof are each described on the basis of the electrophotographic photoreceptor 1 shown in FIG. 6 as a typical example.

Examples of a conductive substrate 2 include a metallic plate, a metallic drum and a metallic belt which are each formed with metal or alloy, such as aluminum, copper, zinc, stainless steel, chromium, nickel, molybdenum, vanadium, indium, gold or platinum. Alternatively, paper, plastic film or belt coated, evaporated or laminated with a conductive polymer, a conductive compound like indium oxide, metal such as aluminum, palladium or gold, or alloy may be used as the conductive substrate 2.

The surface of the conductive substrate 2 is preferably roughened to have a center-line average roughness (Ra) of 0.04 μm to 0.5 μm for the purpose of preventing interference fringes from forming upon irradiation with laser light. When the center-line average roughness (Ra) at the surface of the conductive substrate 2 is smaller than 0.04 μm, the surface is close to a specular surface, so it tends to have insufficient effect on prevention of interference. On the other hand, when the center-line average roughness (Ra) is greater than 0.5 μm, the coat formed on such a surface tends to provide unsatisfactory image quality. Use of incoherent light as a light source requires no particular surface roughening treatment for prevention of interference fringes and can prevent defects from developing by surface roughness of the conductive substrate 2, so it is suited to increase the longevity of the photoreceptor.

Examples of a method for surface roughening include wet honing that is carried out by spraying an aqueous suspension of abrasive on a substrate, center-less grinding wherein grinding operation is performed continuously while pressing a substrate against a rotating grindstone, and anodic oxidation treatment.

As another method for surface roughening, the method of dispersing a conductive or semi-conductive powder into a resin, forming the resulting dispersion into a resin layer on a substrate having undergone no surface roughening treatment on the conductive substrate 2 and roughening the substrate surface by the particles dispersed in the resin layer may be used.

The anodic oxidation treatment uses aluminum as an anode and forms an oxide film on the aluminum surface by carrying out anodic oxidation in an electrolyte solution. As the electrolyte solution, a solution of sulfuric acid, oxalic acid or the like may be used. However, the porous anodic oxide film is chemically active just as it is formed, so it is easily contaminated and has great fluctuations of resistance by environments. Therefore, just-formed porous anodic oxide film may be subjected to sealing treatment for closing fine pores of the anodic oxide film through volumetric expansion caused by hydration reaction in pressured steam or boiling water (to which a metal salt such as a nickel salt may be added) and converting the oxide film into more stable hydrated oxide film.

The thickness of the anodic oxide film is preferably from 0.3 μm to 15 μm. When the thickness is smaller than 0.3 μm, the oxide film tends to have a low injection-resistive barrier and insufficient effect. On the other hand, when the thickness is greater than 15 μm, the oxide film tends to incur an increase in residual potential when used repeatedly.

In addition, the conductive substrate 2 may be subjected to treatment with an aqueous acid solution or boehmite treatment. The treatment with an aqueous acid solution containing phosphoric acid, chromic acid and hydrofluoric acid may be carried out, e.g., as follows. To begin with, an aqueous acid solution for treatment is prepared. As to the mixing proportion between phosphoric acid, chromic acid and hydrofluoric acid in the aqueous acid solution, it is preferable that the proportion of phosphoric acid is from 10% to 11% by weight, that of chromic acid is from 3% to 5% by weight and that of hydrofluoric acid is from 0.5% to 2% by weight. And the total concentration of these acids is preferably from 13.5% to 18% by weight. The treatment temperature is preferably from 42° C. to 48° C. By maintaining the treatment temperature high, thick film can be formed even faster. The thickness of the film formed is preferably from 0.3 μm to 15 μm. When the thickness is smaller than 0.3 μm, the film formed tends to have a low injection-resistive barrier and insufficient effect. On the other hand, when the thickness is greater than 15 μm, the film formed tends to incur an increase in residual potential when used repeatedly.

The boehmite treatment may be performed, e.g., by immersing the conductive substrate 2 in pure water heated to a temperature of 90° C. to 100° C. for a 5- to 60-minute period, or bringing the conductive substrate 2 into contact with steam heated to a temperature of 90° C. to 120° C. for a 5- to 6-minute period. The thickness of film formed is preferably from 0.1 μm to 5 μm. Further, the thus treated substrate may be subjected to anodic oxidation treatment by use of an electrolyte solution having low solubility of the film, such as adipic acid, boric acid, borate, phosphate, phthalate, maleate, benzoate, titarate, citrate or the like.

The subbing layer 4 is formed on the conductive substrate 2. The subbing layer 4 includes, e.g., at least either an organometallic compound or a binding resin.

Examples of the organometallic compound include organozirconium compounds, such as zirconium chelate compounds, zirconium alkoxide compounds and zirconate coupling agents; organotitanium compounds, such as titanium chelate compounds, titanium alkoxide compounds and titanate coupling agents; organoaluminum compounds, such as aluminum chelate compounds and aluminate coupling agents; and further antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicon alkoxide compounds, aluminum titanium alkoxide compounds and aluminum zirconium alkoxide compounds.

Of these organometallic compounds, organozirconium compounds, organotitanium compounds and organoaluminum compounds are used to particular advantage, because they are low in residual potential and contribute to satisfactory electrophotographic properties.

Examples of the binding resin include known polymers, such as polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenol resin, vinyl chloride-vinyl acetate copolymer, epoxy resin, polyvinyl pyrrolidone, polyvinyl pyridine, polyurethane, polyglutamic acid and polyacrylic acid. When two or more of these polymers are used in combination, the mixing proportion between them may be adjusted as required.

In the subbing layer 4, a silane coupling agent may further be incorporated. Examples of the silane coupling agent include vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercapropropyltrimethoxysilane, γ-ureidopropyltriethoxysilane and β-3,4-epoxycyclohexyltrimethoxysilane.

Furthermore, an electron transporting pigment may be used in the subbing layer 4 in a mixed and dispersed state from the viewpoints of reducing residual potential and enhancing environmental stability. Examples of the electron transporting pigment include organic pigments, such as the perylene pigments disclosed in JP-A-47-30330, bisbenzimidazole perylene pigments, polycyclic quinone pigments, indigo pigments and quinacridone pigments; organic pigments including bisazo pigments and phthalocyanine pigments each having an electron attracting substituent, such as a cyano group, a nitro group, a nitroso group or a halogen atom; and inorganic pigments such as zinc oxide and titanium oxide.

Of these pigments, perylene pigments, benzimidazole perylene pigments, polycyclic quinone pigments, zinc oxide and titanium oxide are preferred over the others in point of high ability to transfer electrons.

In addition, these pigments may undergo surface treatment with the coupling agent or the binding resin as recited above for the purpose of controlling their abilities to be dispersed and to transport charges.

Since too high contents of the electron transporting pigment lower the strength of the subbing layer 4 and may cause coating film defects, it is appropriate that the pigment be added in an amount of 95% by weight or below, preferably 90% by weight or below, based on the total solids in the subbing layer 4.

To the subbing layer 4, various kinds of organic compound powders and inorganic compound powders are preferably added for the purpose of improving electric characteristics, light-scattering properties and so on. Specifically, it is effective to add inorganic powders including white pigments such as titanium oxide, zinc oxide, hydrozincite, zinc sulfate, white lead or lithopone, and an extenders such as alumina, calcium carbonate or barium sulfate, and resin powders such as polytetrafluoroethylene resin particles, benzoguanamine resin particles and styrene resin particles.

The volume-average particle size of powder added is preferably from 0.01 μm to 2 μm. Although the powder is added as required, the addition amount thereof is preferably from 10% to 90% by weight, far preferably from 30% to 80% by weight, based on the total solids in the subbing layer 4.

The subbing layer 4 is formed using, e.g., a coating solution containing various ingredients described above as constituents of the subbing layer. The organic solvent used preferably in the coating solution for forming the subbing layer is an organic solvent in which organometallic compounds and binding resins are soluble and neither gelling nor flocculation occurs when an electron transporting pigment is mixed or dispersed therein.

Examples of such an organic solvent include commonly-used solvents, such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used alone, or as mixtures of two or more thereof.

To the method for mixing or dispersing those various ingredients, usual methods using, e.g., a ball mill, a roll mill, a sand mill, an attrition mill, a vibratory ball mill, a colloid mill, a paint shaker and ultrasonic waves, respectively, can be applied. The mixing or dispersing operation is carried out in, e.g., an organic solvent.

As a coating method for formation of the subbing layer 4, usual methods, such as a blade coating method, a wire-bar coating method, a spray coating method, a dip coating method, a bead coating method, an air-knife coating method and a curtain coating method, may be employed.

Drying of the coating layer is usually carried out at temperatures allowing evaporation of the solvent and film formation. Since the conductive substrate 2 having undergone treatment with an acidic solution or boehmite treatment in particular tends to become deficient in hiding power of base material's defects, formation of the subbing layer 4 is favorable.

The thickness of the subbing layer 4 is preferably from 0.01 μm to 30 μm, far preferably from 0.05 μm to 25 μm.

A charge generating layer 5 is formed in a state of incorporating a charge generating material, and further a binding resin as required.

The charge generating material used therein may be any of the heretofore known materials, with examples including organic pigments such as azo pigments (e.g., bisazo and trisazo pigments), aromatic fused-ring pigments (e.g., dibromoanthanthrone), perylene pigments, pyrrolopyrrole pigments and phthalocyanine pigments, and inorganic pigments such as trigonal selenium and zinc oxide. When a light source of exposure wavelengths ranging from 380 nm to 500 nm in particular is used, it is preferable that metal or metal-free phthalocyanine pigment, trigonal selenium, dibromoanthanthorone or the like is used as the charge generating material. Of these pigments, the hydroxygallium phthalocyanines disclosed in JP-A-5-263007 and JP-A-5-279591, the chlorogallium phthalocyanine disclosed in JP-A-5-98181, the dichlorotin phthalocyanines disclosed in JP-A-5-140472 and JP-A-5-140473, and the titanyl phthalocyanines disclosed in JP-A-4-189873 and JP-A-5-43813 are especially preferred over the others.

Of the hydroxygallium phthalocyanines, those showing absorption spectra having their individual absorption maxima in a wavelength region of 810 nm to 839 nm, and having primary particle sizes of 0.10 μm or below and specific surface areas of 45 $m^2/g$ or above as measured by the BET method are especially preferred.

The binding resin may be chosen from a wide range of insulating resins. Alternatively, it may be chosen from organic photoconductive polymers such as poly-N-vinylcarbazole, polyvinyl anthracene, polyvinyl pyrene and polysilane. Suitable examples of the binding resin include insulating resins such as a polyvinyl butyral resin, a polyarylate resin (e.g., a polycondensate of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin and a polyvinyl pyrrolidone resin, but the examples should not be construed as being limited to these resins. Those binding resins may be used alone, or as mixtures of two or more thereof.

The charge generating layer 5 is formed, e.g., by evaporation of a charge generating material, or from a coating solution so prepared as to contain a charge generating material and a binding resin for formation of the charge generating layer. When then charge generating layer 5 is formed using the coating solution for formation of the charge generating layer, the mixing ratio (by weight) between the charge generating material and the binding resin is preferably from 10:1 to 1:10.

To a method of dispersing the ingredients into a coating solution for formation of the charge generating layer, a commonly-used method, such as a ball mill dispersion method, an attrition mill dispersion method or a sand mill dispersion method, may be applied. On this occasion, it is appropriate that such a dispersion method be carried out under conditions that the dispersing operation causes no change in crystal form of the pigment used. In addition, it is effective to carry out the dispersing operation so that the particle size of the pigment used is reduced to preferably 0.5 μm or below, far preferably 0.3 μm or below, further preferably 0.15 μm or below.

Examples of a solvent used for the dispersing operation include commonly-used organic solvents, such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used alone, or as mixtures of two or more thereof.

In forming the charge generating layer 5 by use of a coating solution for formation of the charge generating layer, a general coating method, such as a blade coating method, a wire-bar coating method, a spray coating method, a dip coating method, a bead coating method, an air-knife coating method or a curtain coating method, may be employed.

The thickness of the charge generating layer 5 is preferably from 0.1 μm to 5 μm, far preferably from 0.2 μm to 2.0 μm.

A charge transporting layer 6 is formed in a state of incorporating a charge transporting material and a binding resin in combination, or in a state of incorporating a polymeric charge-transporting material.

Examples of a charge transporting material include electron transporting compounds, such as quinone compounds (e.g., p-benzoquinone, chloranil, bromanil, anthraquinone), tetraquinodimethane compounds, fluorenone compounds (e.g., 2,4,7-trinitrofluorenone), xanthone compounds, benzophenone compounds, cyanovinyl compounds and ethylene compounds, and hole transporting compounds, such as triarylamine compounds, benzidine compounds, arylalkane compounds, aryl-substituted ethylene compounds, stilbene compounds, anthracene compounds and hydrazone compounds, but they should not be construed as being limited to these compounds. These charge transporting materials may be used alone, or as mixtures of two or more thereof.

The charge transporting materials used to advantage in point of mobility are compounds represented by the following formula (a-1), (a-2) or (a-3).

(a-1)

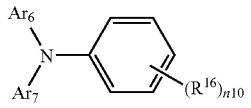

In the formula (a-1), $R^{16}$ represents a hydrogen atom or a methyl group, n10 represents 1 or 2, and each of $Ar_6$ and $Ar_7$ independently represents an aryl group with or without a substituent, $—C_6H_4—C(R^{38})=C(R^{39})(R^{40})$ or $—C_6H_4—CH=CH—CH=C(Ar)_2$. Herein, examples of the substituent include a halogen atom, an alkyl group having 1 to 5 carbon atoms, an alkoxy group having 1 to 5 carbon atoms, and an amino group substituted with an alkyl group having 1 to 3 carbon atoms. And each of $R^{38}$, $R^{39}$ and $R^{40}$ represents a hydrogen atom, a substituted or unsubstituted alkyl group or a substituted or unsubstituted aryl group, and Ar represents a substituted or unsubstituted aryl group.

(a-2)

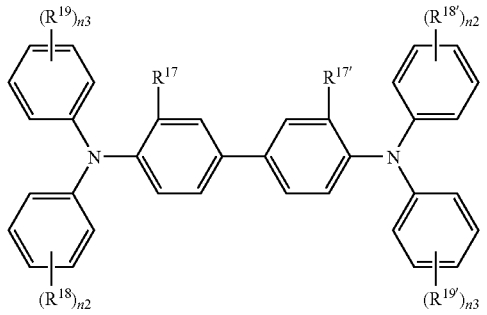

In the formula (a-2), each of $R^{17}$ and $R^{17'}$ independently represents a hydrogen atom, a halogen atom, an alkyl group having 1 to 5 carbon atoms or an alkoxy group having 1 to 5 carbon atoms, each of $R^{18}$, $R^{18'}$, $R^{19}$ and $R^{19'}$ independently represents a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{38})=(R^{39})(R^{40})$ or $—CH=CH—CH=C(Ar)_2$, each of $R^{38}$, $R^{39}$ and $R^{40}$ independently represents a hydrogen atom, a substituted or unsubstituted alkyl group or a substituted or unsubstituted aryl group, Ar represents a substituted or unsubstituted aryl group, and each of n2 and n3 independently represents an integer of 0 to 2.

maleic anhydride terpolymer, a silicone resin, a silicone-alkyd resin, a phenol-formaldehyde resin, and a styrene-alkyd resin. These binding resins may be used alone, or as mixtures of two or more thereof. The mixing ratio (by weight) between the charge transporting material and the binding resin is preferably from 10:1 to 1:5.

As to the polymeric charge-transporting material, materials known to have charge transporting properties, such as poly-N-vinylcarbazole and polysilane, may be used. In particular, the polyester-type polymeric charge-transporting materials disclosed in JP-A-8-176293 and JP A-8-208820 are preferred over the others because of their high charge transportability.

Although each polymeric charge-transporting material may be used by itself as the ingredient in the charge transporting layer 6, it may be mixed with the binding resin as recited above and formed into film.

The charge transporting layer 6 is formed using, e.g., a coating solution so prepared as to contain the ingredient(s) recited above for formation of the charge transporting layer. Examples of a solvent used in the coating solution for formation of the charge transporting layer are commonly-used organic solvents including aromatic hydrocarbons, such as benzene, toluene, xylene and chlorobenzene; ketones, such as acetone and 2-butanone; halogenated aliphatic hydrocarbons, such as methylene chloride, chloroform and ethylene chloride; and cyclic or linear ethers, such as tetrahydrofuran and ethyl ether. These solvents may be used alone, or as mixtures of two or more thereof.

(a-3)

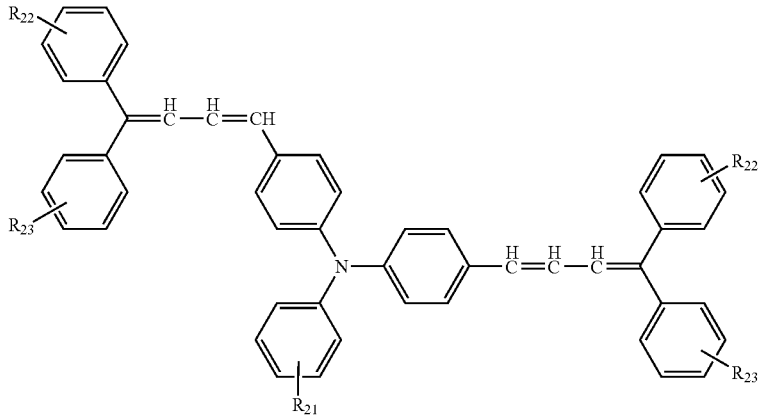

In the formula (a-3), $R_{21}$ represents a hydrogen atom, an alkyl group having 1 to 5 carbon atoms, an alkoxy group having 1 to 5 carbon atoms, a substituted or unsubstituted aryl group, or $—CH=CH—CH=C(Ar)_2$. Ar represents a substituted or unsubstituted aryl group. Each of $R_{22}$ and $R_{23}$ independently represents a hydrogen atom, a halogen atom, an alkyl group having 1 to 5 carbon atoms, an alkoxy group having 1 to 5 carbon atoms, an amino group substituted with an alkyl group having 1 or 2 carbon atoms, or a substituted or unsubstituted aryl group.

Examples of a binding resin used in the charge transporting layer 6 include a polycarbonate resin, a polyester resin, a methacrylic resin, an acrylic resin, a polyvinyl chloride resin, a polyvinylidene chloride resin, a polystyrene resin, a polyvinyl acetal resin, a styrene-butadiene copolymer, a vinylidene chloride-acrylonitrile copolymer, a vinyl chloride-vinyl acetate copolymer, a vinyl chloride-vinyl acetate- As the method of coating a coating solution for formation of the charge transporting layer, a general coating method, such as a blade coating method, a wire-bar coating method, a spray coating method, a dip coating method, a bead coating method, an air-knife coating method or a curtain coating method, may be employed.

The thickness of the charge transporting layer 6 is preferably from 5 μm to 50 μm, far preferably from 10 μm to 30 μm.

To a photoreceptive layer 3, additives including an antioxidant, a light stabilizer, a heat stabilizer and the like may be added for the purposes of preventing deterioration caused in the photoreceptive layer by ozone or an oxidative gas, or light and heat produced in an image forming apparatus.

Examples of an antioxidant which can be added include hindered phenols, hindered amines, p-phenylenediamines, arylalkanes, hydroquinone, spirochroman, spiroindanone, and derivatives of these compounds, organic sulfur compounds and organic phosphorus compounds. Examples of a light stabilizer which can be added include benzophenone, benzotriazole, dithiocarbamate, tetramethylpiperidine, and derivatives of these compounds.

In the photoreceptive layer 3, at least one kind of electron accepting material may also be incorporated for the purposes of increasing the sensitivity, reducing the residual potential, and lessening fatigue during the repeated use.

Examples of such an electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Of these compounds, fluorenone compounds, quinone compounds and benzene derivatives having electron attractive substituents, such as Cl, CN or $NO_2$, are especially preferred over the others.

A protective layer 7 may be made up of, e.g., a resin as mentioned below. Examples of a resin which may be used therein include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride terpolymer, a silicone resin, a silicone-alkyd resin, a phenol-formaldehyde resin, a styrene-alkyd resin, and polymeric charge-transporting materials such as poly-N-vinylcarbazole, polysilane and the polyester-type polymeric charge-transporting materials disclosed in JP-A-8-176293 and JP-A-8-208820. Of these resins, thermosetting resins including a phenol resin, a thermosetting acrylic resin, a thermosetting silicone resin, an epoxy resin, a melamine resin, a urethane resin, a polyimide resin and a polybenzimidazole resin are preferred over the others. Of these thermosetting resins, a phenol resin, a melamine resin, a benzoguanamine resin, a siloxane resin and a urethane resin in particular are preferable to the others. For instance, a coating solution predominantly composed of such a thermosetting resin or a precursor thereof is coated, and then hardened into insoluble film by undergoing heating treatment during the process of drying the solvent.

Examples of a phenol resin include monomers such as monomethylolphenols, dimethylolphenols or trimethylolphenols, mixtures of these monomers, oligomerization products of these monomers or monomer mixtures, and mixtures of these monomers and oligomers. Such a phenol resin is prepared by allowing a compound having a phenolic structure, such as phenol, a substituted phenol having one hydroxyl group (e.g., cresol, xylenol, p-alkylphenol, p-phenylphenol), a substituted phenol having two hydroxyl groups (e.g., catechol, resorcinol, hydroquinone), a bisphenol compound (e.g., bisphenol A, bisphenol Z) or a biphenol compound, to react with formaldehyde, paraformaldehyde or the like in the presence of an acid catalyst or an alkali catalyst. Alternatively, the phenol resin used may be a typical product commercially-designated as phenol resin. However, a resol-type phenol resin is preferred as the phenol resin used. By the way, the term "oligomer" as used herein refers to a relatively large molecule in which the number of repeating structural units is of the order of 2 to 20, and the term "monomer" as used herein refers to a molecule smaller than such an oligomer.

Examples of an acid catalyst usable therein include sulfuric acid, p-toluenesulfonic acid and phosphoric acid, and examples of an alkali catalyst usable therein include hydroxides of alkali metals and alkaline earth metals, such as NaOH, KOH, $Ca(OH)_2$ and $Ba(OH)_2$, and amine catalysts.

Examples of amine catalysts include ammonia, hexamethylenetetramine, trimethylamine, triethylamine and triethanolamine, but they are not limited to these compounds. When a basic catalyst is used, there is a tendency of the catalyst remaining to trap carriers to a considerable degree and degrade electrophotographic characteristics. Therefore, it is appropriate that the residual catalyst be neutralized, or deactivated or removed by being brought into contact with an adsorbent such as silica gel, an ion exchange resin or the like.

As melamine resins and the benzoguanamine, various types of resins including methylol-type resins in which methylol groups are present as they are, full ether-type resins in which all the methylol groups are alkyl-etherified, full imino-type resins, and methylol-imino mixture-type resins may be used. Of these resins, ether-type resins are preferred over the others in point of stability in coating solutions. For example, those resins are synthesized from compounds represented by the following formulae (A) and (B), respectively. The compounds represented by the formula (A) or (B) may be synthesized, e.g., from guanamine or melaine and formaldehyde in accordance with any of the heretofore known methods (see, e.g., *Jikken Kagaku Koza,* 4th Ed., vol. 28, p. 430).

(A)

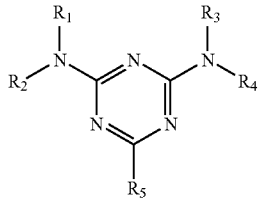

(B)

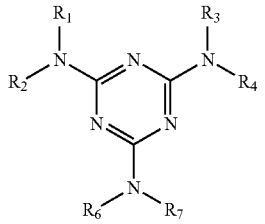

Herein, each of $R_1$ to $R_7$ represents H, $CH_2OH$ or an alkyl ether group.

Specifically, the compounds represented by the formula (A) include compounds having the structures (A)-1 to (A)-22 illustrated below and the compounds represented by the formula (B) include compounds having the structures (B)-1 to (B)-6 illustrated below. Each group of compounds may be used alone, or as mixtures of two or more thereof. Using these compounds in the form of a mixture or an oligomer is preferred, because it can promote organic solvent solubility or main polymer solubility of the compounds.

(A)-1

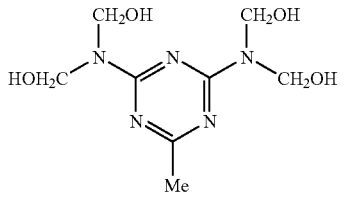

-continued
(A)-2
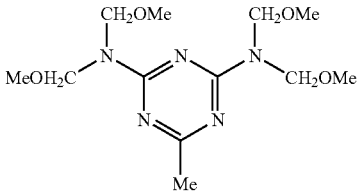
(A)-3
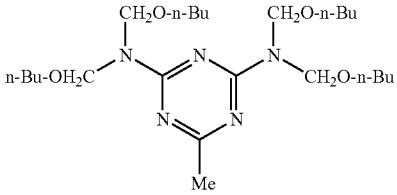
(A)-4
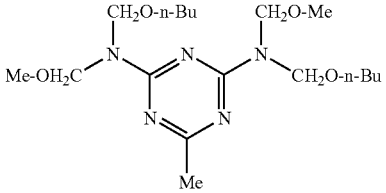
(A)-5
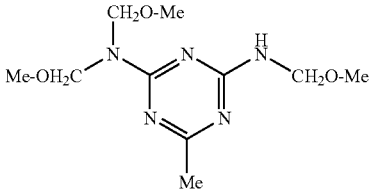
(A)-6
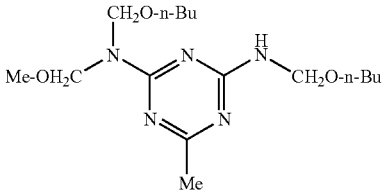
(A)-7
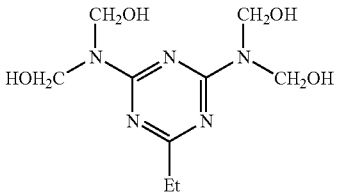
(A)-8
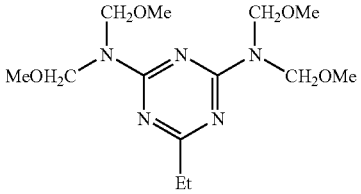
(A)-9
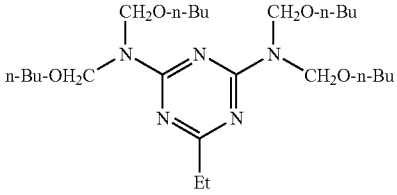
-continued
(A)-10
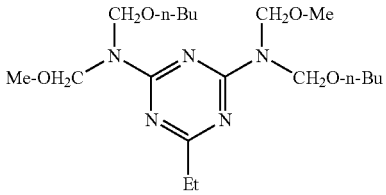
(A)-11
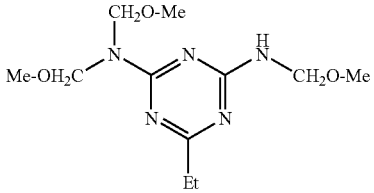
(A)-12
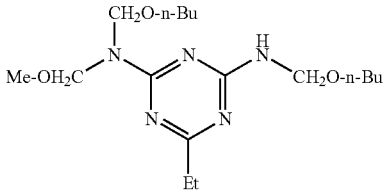
(A)-13
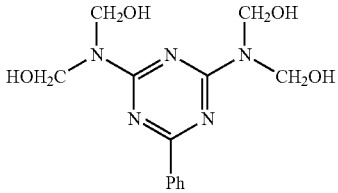
(A)-14
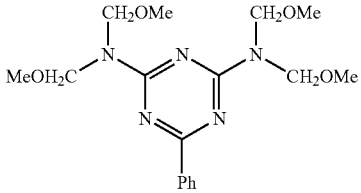
(A)-15
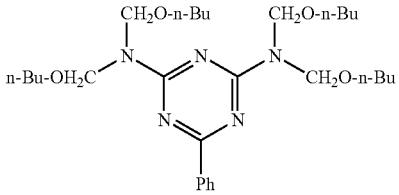
(A)-16
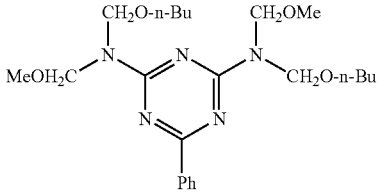
(A)-17
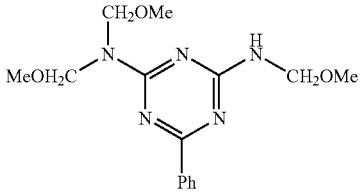

-continued (A)-18

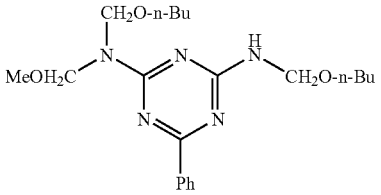

(A)-19

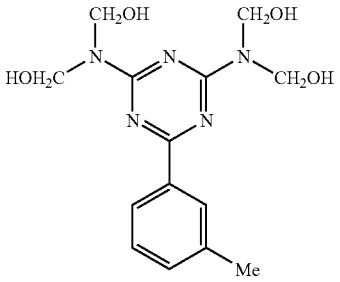

(A)-20

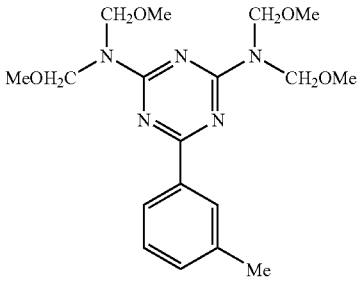

(A)-21

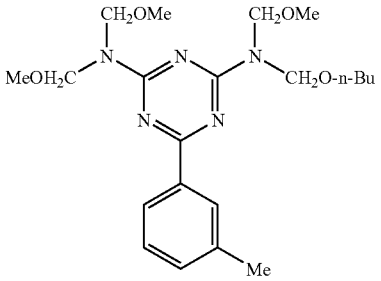

(A)-22

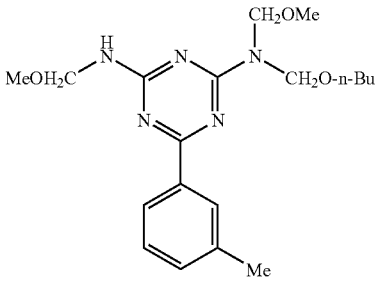

(B)-1

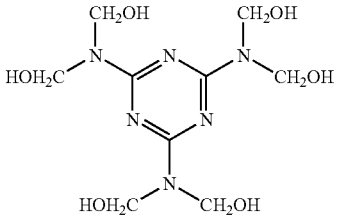

-continued (B)-2

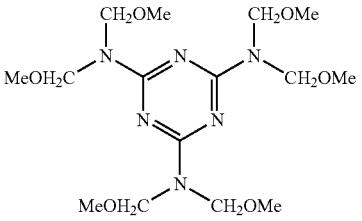

(B)-3

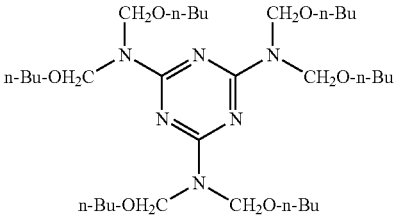

(B)-4

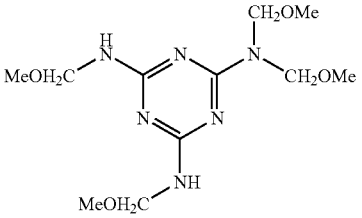

(B)-5

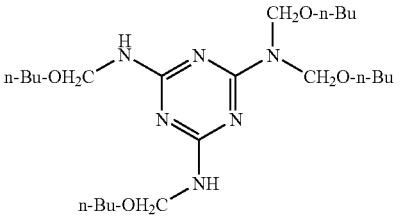

(B)-6

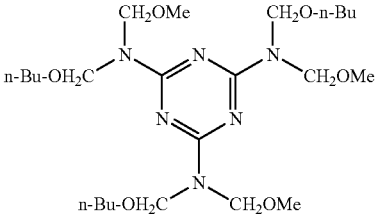

As the melamine resins and the benzoguanamine resins, commercially available products, such as SUPER BECKAMINE (R) L-148-55, SUPER BECKAMINE (R) 13-535, SUPER BECKAMINE (R) L-145-60 and SUPER BECKAMINE (R) TD-126 (products of DIC Corporation), NIKALAC BL-60 and NIKALAC BX-4000 (products of Sanwa Chemical CO., INC.), which are all benzoguanamine resins, SUPER MELAMI No. 90 (a product of NOF CORPORATION), SUPER BECKAMINE (R) TD-139-60 (a product of DIC Corporation), U-VAN 2020 (Mitsui Chemicals, Inc.), SUMITEX RESIN M-3 (a product of Sumitomo Chemical Co., Ltd.) and NIKALAC MW-30 and NIKALAC MW-30M (a product of Sanwa Chemical CO., INC.), may be used as they are.

As the urethane resins, polyfunctional isocyanates, isocyanurates or blocked isocyanates obtained by blocking them with alcohol or ketone may be used. Of these isocyanates, blocked isocyanates or isocyanurates are preferred in point of stability in coating solutions and because of their capability of thermally crosslinking with additives for an electrophotographic photoreceptor used in an image forming apparatus according to an exemplary embodiment of the invention.

The silicone resin used may be a resin derived from, e.g., a compound represented by the formula (X) illustrated below.

The resins as recited above may be used alone, or as mixtures of two or more thereof.

To the protective layer 7, conductive particles may be added for the purpose of lowering the residual potential. Examples of conductive particles include metal particles, metal oxide particles and carbon black. Of these particles, metal particles and metal oxide particles are preferable. Examples of metal particles include aluminum particles, zinc particles, copper particles, chromium particles, nickel particles, silver particles, stainless steel particles and metal-evaporated plastic particles. And examples of metal oxide particles include zinc oxide particles, titanium oxide particles, tin oxide particles, antimony oxide particles, indium oxide particles, bismuth oxide particles, tin-doped indium oxide particles, antimony- or tantalum-doped tin oxide particles, and antimony-doped zirconium oxide particles. Each kind of particles may be used by itself, or two or more kinds of particles may be used in combination. When two or more kinds of particles are used in combination, they may be mixed simply or formed into a solid solution, or they may take the form of melt. The average size of conductive particles is preferably 0.3 μm or below, far preferably 0.1 μm or below, from the viewpoint of transparency of the protective layer 7.

To the curable resin composition for forming the protective layer 7, compounds represented by the following formula (X) may further be added with the intention of controlling various physical properties such as strength and film resistance of the protective layer 7.

$$Si(R^{50})_{(4-c)}Q_c \quad (X)$$

In the formula (X), $R^{50}$ represents a hydrogen atom, an alkyl group, or a substituted or unsubstituted aryl group, Q represents a hydrolyzable group, and c is an integer of 1 to 4.

Examples of a compound represented by the formula (X) include silane coupling agents as recited below. Specifically, the silane coupling agents include tetrafunctional alkoxysilanes (c=4), such as tetramethoxysilane and tetraethoxysilane; trifunctional alkoxysilanes (c=3), such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyltriethoxysilane; difunctional alkoxysilanes (c=2), such as dimethyldimethoxysilane, diphenyldimethoxysilane and methylphenyldimethoxysilane; and monofunctional alkoxysilanes (c=1), such as trimethylmethoxysilane. For enhancement of the film strength, tri- and tetra-functional alkoxysilanes are preferable; while mono- and di-functional alkoxysilanes are preferable for enhancement of flexibility and film formability.

Alternatively, hard coat agents prepared mainly from those coupling agents may be used. Examples of commercial products usable as such hard coat agents include KP-85, X-40-9740 and X-40-2239 (which are products of Shin-Etsu Silicones), and AY42-440, AY42-441 and AY49-208 (which are products of Dow Corning Toray Co., Ltd.).

In the curing resin composition for forming the protective layer 7, a compound having at least two silicon atoms as represented by the following formula (XI) is also preferably used in order to enhance the strength of the protective layer 7.

$$B-(Si(R^{51})_{(3-d)}Q_d)_2 \quad (XI)$$

In the formula (XI), B represents a divalent organic group, $R^{51}$ represents a hydrogen atom, an alkyl group or a substituted or unsubstituted aryl group, Q represents a hydrolyzable group, and d represents an integer of 1 to 3.

Specifically, the preferred among compounds represented by the formula (XI) include Compound (XI-1) to Compound (XI-16) shown in the following table. In the table, Me stands for a methyl group, and Et stands for an ethyl group.

| | |
|---|---|
| XI-1 | $(MeO)_3Si—(CH_2)_2—Si(OMe)_3$ |
| XI-2 | $(MeO)_2MeSi—(CH_2)_2—SiMe(OMe)_2$ |
| XI-3 | $(MeO)_2MeSi—(CH_2)_6—SiMe(OMe)_2$ |
| XI-4 | $(MeO)_3Si—(CH_2)_6—Si(OMe)_3$ |
| XI-5 | $(EtO)_3Si—(CH_2)_6—Si(OEt)_3$ |
| XI-6 | $(MeO)_2MeSi—(CH_2)_{10}—SiMe(OMe)_2$ |
| XI-7 | $(MeO)_3Si—(CH_2)_3—NH—(CH_2)_3—Si(OMe)_3$ |
| XI-8 | $(MeO)_3Si—(CH_2)_3—NH—(CH_2)_2—NH—(CH_2)_3—Si(OMe)_3$ |
| XI-9 | 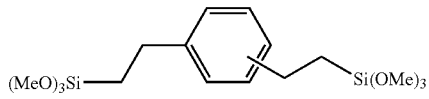 |
| XI-10 | 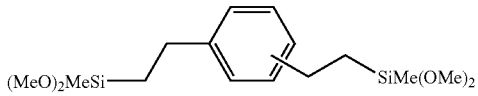 |
| XI-11 | 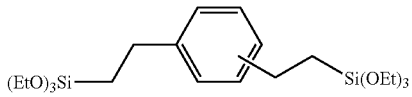 |

-continued

XI-12

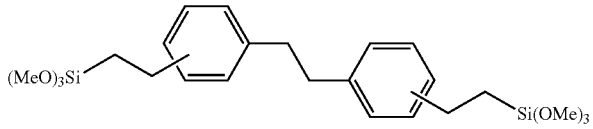

XI-13

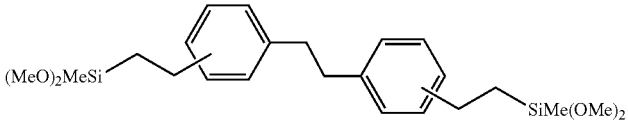

XI-14

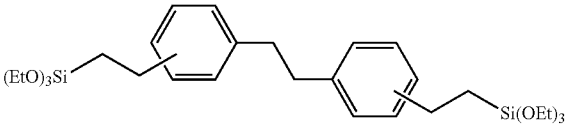

XI-15 $(MeO)_3SiC_3H_6—O—CH_2CH\{—O—C_3H_6Si(OMe)_3\}—CH_2[—O—C_3H_6Si(OMe)_3\}$

XI-16 $(MeO)_3SiC_2H_4—SiMe_2—O—SiMe_2—O—SiMe_2—C_2H_4Si(OMe)_3$

For the purposes of controlling film properties, increasing a solution life and so on, resins soluble in alcohol solvents, ketone solvents or the like may further be added. Examples of such resins include polyvinyl acetal resins, such as a polyvinyl butyral resin, a polyvinyl formal resin and a partially acetalated polyvinyl butyral resin prepared by modifying part of the butyral moieties with formal or acetoacetal (e.g., S-LEC B, S-LEC K, products of SEKISUI CHEMICAL CO., LTD.), polyamide resins, cellulose resins and phenol resins. Of these resins, polyvinyl acetal resins in particular are preferred from the viewpoint of enhancing electric characteristics.

Further, various kinds of resins may be added for the purposes of enhancing discharge gas resistance, mechanical strength, scratch resistance and dispersibility of particles, controlling the viscosity, reducing torque, controlling abrasion loss, increasing a pot life and so on. In this exemplary embodiment of the invention, it is preferable that an alcohol-soluble resin is further added. Examples of a resin soluble in alcohol solvents include polyvinyl acetal resins, such as a polyvinyl butyral resin, a polyvinyl formal resin and a partially acetalated polyvinyl butyral resin prepared by modifying part of the butyral moieties with formal or acetoacetal (e.g., S-LEC B, S-LEC K, products of SEKISUI CHEMICAL CO., LTD.), polyamide resins and cellulose resins. Of these resins, polyvinyl acetal resins in particular are preferred from the viewpoint of enhancing electric characteristics.

The weight-average molecular weight of the resin added is preferably from 2,000 to 100,000, far preferably from 5,000 to 50,000. When the resin added has a weight-average molecular weight lower than 2,000, there is a tendency toward failing to achieve the desired effect; while, when the resin added has a weight-average molecular weight higher than 100,000, it has low solubility, so its addition amount tends to be limited and film formation failure tends to be caused at the time of coating. The addition amount is preferably from 1% to 40% by weight, far preferably from 1% to 30% by weight, especially preferably from 5% to 20% by weight. When the addition amount is smaller than 1% by weight, the desired effect is hard to achieve; while, when addition amount is greater than 40% by weight, there is a fear of easy occurrence of image blur under circumstances of high temperature and humidity. Moreover, those resins may be used alone, or as mixtures of two or more thereof.

For the purposes of increasing a pot life, controlling film characteristics and so on, it is appropriate that a cyclic compound having repeating structural units represented by the following formula (XII) or a derivative from such a compound be further incorporated.

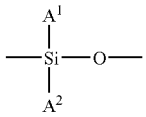

(XII)

In the formula (XII), each of $A^1$ and $A^2$ independently represents a univalent organic group.

As the cyclic compounds having the repeating structural units represented by the formula (XII), commercially available cyclic siloxanes may be used. Examples of such cyclic siloxanes include cyclic dimethylcyclosiloxanes, such as hexamethylcyclotrisiloxane, octamethylcyclotetrasiloxane, decamethylcyclopentasiloxane and dodecamethylcyclohexasiloxane; cyclic methylphenylcyclosiloxanes, such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane; cyclic phenylcyclosiloxanes, such as hexaphenylcyclotrisiloxane; fluorine atom-containing cyclosiloxanes, such as 3-(3,3,3,-trifluoropropyl)methylcyclotrisiloxane; methylhydrosiloxane mixtures; pentamethylcyclopentasiloxane; hydrosilyl group-containing cyclosiloxanes, such as phenylhydrocyclosiloxane; and vinyl group-containing cyclosiloxanes, such as pentavinylpentamethylcyclopentasiloxane. These cyclic siloxane compounds may be used alone, or as mixtures of two or more thereof.

Furthermore, various kinds of particles may be added to a curing resin composition for formation of the protective layer 7 in order to control contaminant adhesion resistance, lubricity, hardness and other properties of the electrophotographic photoreceptor surface.

As an example of such particles, silicon atom-containing particles can be given. The silicon atom-containing particles are particles containing silicon as their individual constituent elements, and examples thereof include colloidal silica and silicone particles. The colloidal silica used as silicon atom-containing particles has its volume-average particle size in a range of preferably 1 nm to 100 nm, far preferably 10 nm to 30 nm, and is chosen from acidic or alkaline aqueous dispersions of silica or dispersions of silica in organic solvents such as alcohol, ketone or ester. And colloidal silica products generally sold on the market may be used. The solid-base colloidal silica content in a curing resin composition has no particular limits but, in terms of film formability, electric characteristics, strength and so on, it is preferably from 0.1% to 50% by weight, far preferably from 0.1% to 30% by weight, based on the total solids in the curing resin composition.

Silicone particles used as the silicon atom-containing particles are preferably those having the shape of a sphere in a substantial sense and a volume-average particle size ranging from 1 nm to 500 nm, especially from 10 nm to 100 nm, and chosen from silicone resin particles, silicone rubber particles or silica particles having undergone surface treatment with silicone. They may be commercial products generally sold on the market.

Since silicone particles are small-diameter particles which are chemically inert and have excellent dispersibility into resins, and besides, whose content required to impart the desired properties is low, they can improve surface conditions of the electrophotographic photoreceptor almost without inhibiting crosslinking reaction. More specifically, in a state of being incorporated in a firm cross-linked structure in a substantially homogeneous state, silicone particles can improve the surface properties of an electrophotographic photoreceptor, including lubricity, water repellency and so on, and contribute to long-term retention of satisfactory abrasion resistance, contaminant adhesion resistance and so on. The content of silicone particles in a curing resin composition is preferably from 0.1% to 30% by weight, far preferably from 0.5% to 10% by weight, based on the total solids in the curing resin composition.

Examples of other kinds of particles include fluorine-containing particles, such as particles of polytetrafluoroethylene, those of polytrifluoroethylene, polyhexafluoropropylene, those of polyvinyl fluoride and those of polyvinylidene fluoride; particles formed so as to include a resin obtained by copolymerizing a hydroxyl group-containing monomer and the fluorocarbon resin as described in *The 8th Polymer Material Forum Preprints*, p. 89, and particles of a semiconductive metal oxide, such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO or MgO.

For the purposes of controlling, e.g., contaminant adhesion resistance, lubricity and hardness of the surface of an electrophotographic photoreceptor, oils including a silicone oil and the like may also be added. Examples of the silicone oil include silicone oils such as dimethylpolysiloxane, diphenylpolysiloxane and phenylmethylpolysiloxane, and reactive silicone oils, such as amino-modified polysiloxane, epoxy-modified polysiloxane, carboxyl-modified polysiloxane, carbinol-modified polysiloxane, methacryl-modified polysiloxane, mercapto-modified polysiloxane and phenol-modified polysiloxane. These oils each may be added in advance to a curing resin composition for forming the protective layer 7 or, after making a photoreceptor, the photoreceptor may be impregnated with such a silicone oil under a reduced pressure or under a pressurized condition.

Additives including a plasticizer, a surface reforming agent, an antioxidant, a photodegradation inhibitor and so on may also be contained. Examples of the plasticizer include biphenyl, biphenyl chloride, terphenyl, dibutyl phthalate, diethylene glycol phthalate, dioctyl phthalate, triphenyl phosphate, methylnaphthalene, benzophenone, chlorinated paraffin, polypropylene, polystyrene and various fluorinated hydrocarbons.

In addition, an antioxidant, such as a hindered phenol, a hindered amine or an antioxidant having a thioether or phosphite moiety as its partial structure can be added. The addition of such an antioxidant is effective for enhancement of potential stability and image quality under environmental variation.

Examples of an antioxidant include hindered phenol antioxidants, such as Sumilizer BHT-R, Sumilizer MDP-S, Sumilizer BBM-S, Sumilizer WX-R, Sumilizer NW, Sumilizer BP-76, Sumilizer BP-101, Sumilizer GA-80, Sumilizer GM and Sumilizer GS (which are products of Sumitomo Chemical Co., Ltd.), IRGANOX 1010, IRGANOX 1035, IRGANOX 1076, IRGANOX 1098, IRGANOX 1135, IRGANOX 1141, IRGANOX 1222, IRGANOX 1330, IRGANOX 1425WL, IRGANOX 1520L, IRGANOX 245, IRGANOX 259, IRGANOX 3114, IRGANOX 3790, IRGANOX 5057 and IRGANOX 565 (which are products of Ciba Specialty Chemicals), ADK STAB AO-20, ADK STAB AO-30, ADK STAB AO-40, ADK STAB AO-50, ADK STAB AO-60, ADK STAB AO-70, ADK STAB AO-80 and ADK STAB AO-330 (which are products of ADEKA CORPORATION); hindered amine antioxidants, such as SANOL LS2626, SANOL LS765, SANOL LS770 and SANOL LS744 (which are products of Sankyo Lifetec Co.), TINUVIN 144 and TINUVIN 622LD (which are products of Ciba Specialty Chemicals), MARK LA57, MARK LA67, MARK LA62, MARK LA68 AND MARK LA63 (which are products of ADEKA CORPORATION) and Sumilizer TPS (which is a product of Sumitomo Chemical Co., Ltd.); thioether antioxidants, such as Sumilizer TP-D (which is a product of Sumitomo Chemical Co., Ltd.); and phosphite anitoxidants, such as MARK 2112, MARK PEP•8, MARK PEP•24G, MARK PEP•36, MARK 329K and MARK HP•10 (which are products of ADEKA CORPORATION). Of these antioxidants, hindered phenol antioxidants and hindered amine antioxidants are especially preferred. These antioxidants may be modified with groups capable of causing crosslinking reaction with a cross-linked film forming material, such as alkoxysilyl groups.

Further, it is preferable that resins having cross-linked structures, such as a phenol resin, a melamine resin and a benzoguanamine resin, undergo certain treatment for removal of catalysts used in their syntheses. For instance, such a resin is dissolved in an appropriate solvent, such as methanol, ethanol, toluene or ethyl acetate, washed with water and then reprecipitated with a poor solvent, or undergoes treatment with a material as recited below. Examples of a material usable for the treatment include cation exchange resins, such as AMBERLITE 15, AMBERLITE 200C, AMBERLYST 15E (which are products of Rohm and Haas Company), DOWEX MWC-1-H, DOWEX 88, DOWEX HCR-W2 (which are products of The Dow Chemical Company), Lewatit SPC-108 and Lewatit SPC-118 (which are products of Bayer AG), DIAION RPC-150H (which is a product of Mitsubishi Chemical Corporation), SUMIKAION KC-470, DUOLITE C26-C, DUOLITE C-433 and DUOLITE-464 (which are products of Sumitomo Chemical Co., Ltd.), and Nafion-H (which is a product of E.I. du Pont Nemours and Company); anion exchange resins, such as AMBERLITE IRA-400 and AMBERLITE IRA-45 (which are products of Rohm and Haas Company); inorganic solids to the surfaces of which proton acid moiety-containing groups are attached, such as $Zr(O_3PCH_2CH_2SO_3H)_2$ and $Th(O_3PCH_2CH_2COOH)_2$; polyorganosiloxnes having proton acid groups, such as polyorganosiloxane having sulfonic acid groups; hetero polyacids, such as cobalttungstic acid and phosphomolybutic acid; isopolyacids, such as niobic acid, tantalic acid and molybdic acid; monometal oxides, such as silica gel, alumina, chromia, zirconia, CaO and MgO; compound metal oxides, such as silica-alumina, silica-magnesia, silica-zirconia and zeolites; clay minerals, such as acid clay, activated clay, montmorillonite and kolinite; metal sulfates, such as $LiSO_4$ and $MgSO_4$; metal phosphates, such as zirconia phosphate and lanthanum phosphate; metal nitrates, such as $LiNO_3$ and $Mn(NO_3)_2$; inorganic solids to the surface of which amino moiety-containing groups are attached, such as solids obtained by making aminopropyltriethoxysilane react on silica gel; and amino group-containing polyorganosiloxanes, such as an amino-modified silicone resin.

For adjusting film properties including hardness, adhesiveness, flexibility and so on, epoxy-containing compounds, such as polyglycidyl methacrylate, glycidyl bisphenols and phenol epoxy resins, terephthalic acid, maleic acid, pyromellitic acid, biphenyltetracarboxylic acid or acid anhydrides of these acids may be added. These compounds are preferably used in proportions of 0.05 to 1 parts by weight, especially 0.1 to 0.7 parts by weight, to 1 parts by weight of additives for the electrophotographic photoreceptor according to an exemplary embodiment of the invention.

An insulating resin, such as a polyvinyl butyral resin, a polyarylate resin (a polycondensate of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin or a polyvinyl pyrrolidone resin, may be mixed in a desired proportion. By doing so, adhesion to the charge transporting layer 6 is enhanced, and defects of the coating film formed, such as thermal shrinkage and repellency, can be inhibited.

The protective layer 7 is formed by using, e.g., the coating solution prepared so as to contain the variety of ingredients recited above for forming the protective layer. In other words, the protective layer 7 is formed, e.g., by coating and curing the coating solution for protective layer formation on the charge transporting layer 6.

In the coating solution for protective layer formation, a solvent such as alcohol (e.g., methanol, ethanol, propanol, butanol), ketone (e.g., acetone, methyl ethyl ketone), tetrahydrofuran or ether (e.g., diethyl ether, dioxane) may be used if needed. Although various other solvents may be used, an alcohol or ketone solvent or a mixture thereof is used to advantage in the application of a dip coating method commonly used for manufacturing electrophotographic photoreceptors. Additionally, solvents having a boiling temperature of 50° C. to 150° C. are preferably used, and they may be used in a state of being mixed in arbitrary proportions. The amount of solvent used may be set arbitrarily, but the solvent used in a too small amount tends to cause precipitation. Therefore, such solvents are preferably used in proportions of 0.5 to 30 parts by weight, especially 1 to 20 parts by weight, to 1 parts by weight of the total solids contained in the coating solution for protective layer formation.

In forming cross-links, a curing catalyst may further be used in the coating solution for protective layer formation. Examples of a curing catalyst suitably used therein include photoacid generators such as bissulfonyldiazomethanes (e.g., bis(isopropylsulfonyl)diazamethane), bissulfonylmethanes (e.g., methylsulfonyl-p-toluenesulfonylmethane), sulfonylcarbonyldiazomethanes (e.g., cyclohexylsulfonylcyclohexylcarbonyldiazomethane), sulfonylcarbonylalkanes (e.g., 2-methyl-2-(4-methylphenylsulfonyl)propiophenone), nitrobenzyl sulfonates (e.g., 2-nitrobenzyl-p-toluene sulfonate), alkyl and aryl sulfonates (e.g., pyrogallol trismethanesulfonate), benzoin sulfonates (e.g., benzoin tosylate), N-sulfonyloxyimides (e.g., N-(trifluoromethylsulfonyloxy)phthalimide), pyridones (e.g., (4-fluorobenzenesulfonyloxy)-3,4,6-trimethyl-2-pyridone), sulfonic acid esters (e.g., 2,2,2-trifluoro-1-trifluoromethyl-1-(3-vinylphenyl)-ethyl-4-chlorobenzene sulfonate) and onium salts (e.g., triphenylsulfonium methanesulfonate, diphenyliodonium trifluoromethanesulfonate; compounds prepared by neutralizing proton acids or Lewis acids with Lewis bases, mixtures of Lewis acids and trialkyl phosphates, sulfonic acid esters, phosphoric acid esters, onium compounds, carboxylic acid anhydride compounds, and the like.

The compounds prepared by neutralizing proton acids or Lewis acids with Lewis bases include compounds prepared by neutralizing halogenocarboxylic acids, sulfonic acids, sulfuric acid monoesters, phosphoric acid mono- or diesters, polyphosphoric acid esters, or boric acid mono- or diesters with ammonia, various kinds of amines such as monoethylamine, triethylamine, pyridine, piperidine, aniline, morpholine, cyclohexylamine, n-butylamine, monoethanolamine, diethanolamine and triethanolamine, trialkylphosphines, triarylphosphines, trialkylphosphites or trialkylphosphites; commercially available acid-base blocked catalysts, such as NACURE 2500X, 4167, X-47-110, 3525 and 5225 (trade name, products of King Industries, Inc.); and the like. The compounds prepared by neutralizing Lewis acids with Lewis bases include compounds prepared by neutralizing Lewis acids, such as $BF_3$, $FeCl_3$, $SnCl_4$, $AlCl_3$ and $ZnCl_2$, with the Lewis bases as recited above, and the like.

The onium compounds include triphenylsulfonium methanesulfonate, diphenyliodonium trifluoromethanesulfonate, and the like.

The carboxylic acid anhydride compounds include acetic anhydride, propionic anhydride, butyric anhydride, isobutyric anhydride, lauric anhydride, oleic anhydride, stearic anhydride, n-caproic anhydride, n-caprylic anhydride, n-capric anhydride, palmitic anhydride, myristic anhydride, trichloroacetic anhydride, dichloroacetic anhydride, monochloroacetic anhydride, trifluoroacetic anhydride, heptafluorobutyric anhydride, and the like.

Examples of a Lewis acid include metal halides, such as boron trifluoride, aluminum trichloride, titanous chloride, titanic chloride, ferrous chloride, ferric chloride, zinc chloride, zinc bromide, stannous chloride, stannic chloride, stannous bromide and stannic bromide; organometallic compounds, such as trialkhylboron, trialkylaluminum, dialkylhalogenoaluminum, monoalkylhalogenoaluminum and tetraalkyltin; metal chelate compounds, such as diisopropoxyethylacetoacetatealuminum, tris(ethylacetoacetate)aluminum, tris(acetylacetonato)aluminum, diisopropoxy bis(ethylacetoacetate) titanium, diisopropoxy bis(acetylacetonato) titanium, tetrakis(n-propylacetoacetate) zirconium, tetrakis(acetylacetonato)zirconium, tetrakis(ethylacetoacetate)zirconium, dibutyl bis(acetylacetonato) tin, tris(acetylacetonato)iron, tris(acetylacetonato)rhodium, bis(acetylacetonato)zinc and tris(acetylacetonato)cobalt; and metallic soaps, such as dibutyltin dilaurate, dioctyltin ester malate, magnesium naphthenate, calcium naphthenate, manganese naphthenate, iron naphthenate, cobalt naphthenate, cupper naphthenate, zinc naphthenate, zirconium naphthenate, lead naphthenate, calcium octylate, manganese octylate, iron octylate, cobalt octylate, zinc octylate, zirconium octylate, tin octylate, lead octylate, zinc octylate, magnesium stearate, aluminum stearate, calcium stearate, cobalt stearate, zinc stearate and lead stearate. These Lewis acids may be used alone, or as combinations of two or more thereof.

The amount of these catalysts used has no particular limits, but it is preferable that they are used in proportions of 0.1 to 20 parts by weight, especially 0.3 to 10 parts by weight, to 100 parts by weight of the total solids contained in the coating solution for protective layer formation.

The method used in coating a coating solution for protective layer formation on the charge transporting layer 6 may be a commonly-used method, such as a blade coating method, a Meyer bar coating method, a spray coating method, a dip coating method, a bead coating method, an air-knife coating method or a curtain coating method. After coating, the coating film is dried to form the protective layer 7.

When the film coated cannot have a predetermined thickness by onetime coating, the predetermined thickness may be attained by recoating the coating solution many times. When the recoating is carried out over many times, heating treatment may be conducted each time the coating solution is coated, or it may be conducted after the recoating over many times is completed.

When the protective layer 7 is formed by use of a resin capable of having a cross-linked structure, the curing temperature setting for formation of cross-links is preferably from 100° C. to 170° C., far preferably from 100° C. to 160° C. And the curing time setting is preferably from 30 minutes to 2 hours, far preferably from 30 minutes to 1 hour. The heating temperature may be changed in stages.

By performing cross-linking reaction in an atmosphere of the so-called oxidation-inactive gas, such as nitrogen, helium or argon, degradation in electric characteristics may be prevented. When the crosslinking reaction is carried out in an inert gas atmosphere, the curing temperature may be set at higher temperatures than that in the case of carrying out the crosslinking reaction in an atmosphere of air. The curing temperature is preferably from 100° C. to 180° C., far preferably from 110° C. to 160° C., and the curing time is preferably from 30 minutes to 2 hours, far preferably from 30 minutes to 1 hour.

The thickness of the protective layer 7 is preferably from 0.5 μm to 15 μm, far preferably from 1 μm to 10 μm, and further preferably from 1 μm to 5 μm.

The oxygen permeability coefficient of the protective layer 7 as measured at 25° C. is preferably $4\times10^{12}$ fm/s·Pa or below, far preferably $3.5\times10^{12}$ fm/s·Pa or below, and further preferably $3\times10^{12}$ fm/s·Pa or below.

Herein, the oxygen permeability coefficient is a yardstick for describing the perviousness of a layer to oxygen gas, but when viewed from another angle, it may be understood to be a substitution characteristic for physical porosity of the layer. Although the absolute value of permeability varies with gases, there occurs almost no reversal of the magnitude relation between layers under test. Therefore, the oxygen permeability coefficient may be translated as a yardstick for describing perviousness to gases in general.

In other words, when the oxygen permeability coefficient of the protective layer 7 satisfies the foregoing condition as measured at 25° C., gases can hardly permeate the protective layer 7. As a result, discharge products formed in the process of forming images are inhibited from permeating the protective layer 7, and thereby the compounds contained in the protective layer 7 are prevented from deteriorating, the electric characteristics are kept at high levels, and increases in image quality and lifespan are achieved effectively.

In the case of forming a single-layer photoreceptive layer in the electrophotographic photoreceptor 1, a charge generating material and a binding resin are incorporated in the single-layer photoreceptive layer. As the charge generating material, the same ones as usable in the charge generating layer of the function-division photoreceptive layer may be used, and as the binding resin may be used the same ones as usable in the charge generating layer and the charge transporting layer of the function-division photoreceptive layer. The charge-generating material content in a single-layer photoreceptive layer is preferably from 10% to 85% by weight, far preferably from 20% to 50% by weight, based on the total solids in the single-layer photoreceptive layer. For the purposes of improving photoelectric characteristics and so on, a charge transporting material and a charge transporting polymeric material may be added to the single-layer photoreceptive layer. The addition amount of such a material is preferably from 5% to 50% by weight based on the total solids in the single-layer photoreceptive layer. The solvent and the method used for coating may be the same ones as used for each of the foregoing constituent layers. The film thickness of the single-layer photoreceptive layer is preferably of the order of 5 μm to 60 μm, far preferably from 10 μm to 50 μm.

In the next place, a developing device 25 is described. The developing device 25 is an unit for forming toner images by developing latent images on the electrophotographic photoreceptor 1.

Toner usable in the developing device is illustrated below.

The toner's average shape factor SF1 (SF1=$(ML^2/A)\times(\pi/4)\times100$), where ML represents a maximal particle length (μm) and A represents a particle's projected area ($\mu m^2$) is preferably from 100 to 150, far preferably from 100 to 140. The average shape factor (SF1) is determined as follows. The images of toner particles mounted on a glass slide and scanned by an optical microscope are shot with a video camera and captured in an image analyzer (LUZEX III, made by NIRECO CORPORATION), thereby determining the toner's maximal length (ML) and projected area (A). The thus determined values are substituted into the equation of SF1 to yield a shape factor. Herein, the average shape factor is an average of shape factor values calculated from the equation with respect to 100 toner particles chosen arbitrarily.

Further, the volume-average particle size of toner is preferably from 2 μm to 12 μm, far preferably from 3 μm to 12 μm, and further preferably from 3 μm to 9 μm. By using toner satisfying such average shape factor and volume-average particle size requirements, high developability, high transferability and high quality images can be obtained.

Toner has no particular restriction as to its manufacturing method so long as the toner is within the bounds satisfying the foregoing average shape factor and volume-average particle size requirements. For instance, it is possible to use the toner manufactured by a kneading pulverization method, which includes process steps of mixing a binding resin, a colorant and a release agent, adding thereto an electrification control agent as required, and subjecting the resulting mixture to kneading, pulverizing and classification operations; a method of applying mechanical impact force or thermal energy to toner particles obtained by the kneading pulverization method to change the shapes of the particles; an emulsion-polymerization aggregation method, which includes process steps of performing emulsion polymerization of a polymerizable monomer for binding resin formation, mixing the resulting emulsion with a dispersion containing a colorant and a release agent, and further an electrification control agent as required, thereby causing aggregation, and fusing the aggregates by heating to form toner particles; a suspension polymerization method, which includes process steps of suspending a solution containing a polymerizable monomer for binding resin formation, a colorant and a release agent, and further an electrification control agent as required, in an aqueous solvent, and performing polymerization in the suspension; and a dissolved suspension method, which includes process steps of suspending a binding resin and a solution of a colorant and a release agent, and further an electrification control agent as required, in an aqueous solvent, and performing granulation.

In addition, another known method, such as a manufacturing method by which toner of a core-shell structure is formed using the toner obtained by the method as recited above as core, making aggregating particles adhere to the core and fusing them by heating, may be employed. From the viewpoints of shape control and particle-size distribution control, the method preferably used as the toner manufacturing method is a manufacturing method using an aqueous solvent, such as a suspension polymerization method, an emulsion-polymerization aggregation method or a dissolved suspension method, notably an emulsion-polymerization aggregation method.

Mother particles of toner is formed so as to incorporate, e.g., a binding resin, a colorant and a release agent, and further an electrification control agent as required.

Examples of a binding resin usable in mother particles of toner include homopolymers and copolymers of styrenes such as styrene and chlorostyrene, monoolefins such as ethylene, propylene, butylene and isobutylene, vinyl esters such as vinyl acetate, vinyl propionate, vinyl benzoate and vinyl butyrate, α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, or/and vinyl ketones such as vinyl methyl ketone, vinyl hexyl ketone and vinyl isopropenyl ketone; and polyester resins synthesized by copolymerization of dicarboxylic acids and diols.

Examples of especially typical binding resin include polystyrene, styrene-alkyl acrylate copolymers, styrene-alkyl methacrylate copolymers, styrene-acrylonitrile copolymer, styrene-butadiene copolymer, styrene-maleic anhydride copolymer, polyethylene, polypropylene and polyester resins. In addition, polyurethane, epoxy resins, silicone resins, polyamide, denatured rosin and paraffin wax are given as another typical examples.

Examples of a typical colorant include a magnetic powder such as magnetite or ferrite, carbon black, aniline blue, calcoil blue, chrome yellow, ultramarine blue, Du Pont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Examples of a typical release agent include low-molecular-weight polyethylene, low-molecular-weight polypropylene, Fischer-Tropusch wax, montan wax, carnauba wax, rice wax and candelilla wax.

As the electrification control agent, known ones may be used. Specifically, an azo-metal complex compound, a salicylic acid-metal complex compound, a polar group-containing resin or the like may be used as the electrification control agent. When toner is manufactured by a wet method, an ingredient resistant to dissolution is used to advantage in terms of ionic strength control and reduction in wastewater pollution. Additionally, the toner may be either magnetic toner in which a magnetic material is contained, or nonmagnetic toner which contains no magnetic material.

Toner used in the developing device 25 may be manufactured by mixing the mother particles of toner and the external additives by means of a Henschel mixer, a V-blender or the like. Alternatively, the external additives may be added in a wet process when the mother particles of toner is manufactured in a wet process.

To the toner used in the developing device 25, slipping particles may be added. Examples of slipping particles usable therein include solid lubricants such as graphite, molybdenum disulfide, talc, fatty acids and metal salts of fatty acids, low-molecular-weight polyolefins such as polypropylene, polyethylene and polybutene, silicones softening with heat, aliphatic amides such as oleic amide, erucic amide, ricinoleic amide and stearic amide, vegetable wax such as carnauba wax, rice wax, candelilla wax, Japan wax or jojoba oil, animal wax such as beeswax, mineral or petroleum wax such as montan wax, ozocerite, ceresin, paraffin wax, microcrystalline wax or Fischer-Tropusch wax, and modified products of the waxes recited above. These wax materials may be used alone, or as combinations of two or more thereof. However, it is preferable that such wax has a volume-average particle size of 0.1 μm to 10 μm, so wax with the same chemical structure as the wax material as recited above may be pulverized into particles of a uniform size. The amount of wax added to the toner is preferably from 0.05% to 2.0% by weight, far preferably from 0.1% to 1.5% by weight.

To the toner used in the developing device 25, inorganic particles, organic particles or compound particles formed by making inorganic particles adhere to organic particles may be added for the purposes of eliminating extraneous matter and deterioration products on the surface of the electrophotographic photoreceptor, and so on.

As the inorganic particles, various kinds of inorganic oxides, nitrides, borides and the like, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride, can be used to advantage.

Further, the inorganic particles as recited above may be treated with a titanate coupling agent such as tetrabutyl titanate, tetraoctyl titanate, isopropyltriisostearoyl titanate, isopropyltridecylbenzenesulfonyl titanate or bis(dioctylpyrophosphate)oxyacetate titanate, or a silane coupling agent such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane or p-methylphenyltrimethoxysilane. In addition, inorganic particles rendered hydrophobic by treatment with a metal salt of higher fatty acid such as silicon oil, aluminum stearate, calcium stearate are also used to advantage.

As the organic particles, styrene resin particles, styrene-acrylic resin particles, polyester resin particles or urethane resin particles may be used.

The volume-average particle size of those particles is preferably from 5 nm to 1,000 nm, far preferably from 5 nm to 800 nm, further preferably from 5 nm to 700 nm. When the particles added has a volume-average particle size smaller than the lower limit value, they tend to lack abrasive power; while, when the particles have a volume-average particle size greater than the upper limit value, they tend to scratch the electrophotographic photoreceptor surface. And it is preferred that the total addition amount of those particles and the slipping particles be at least 0.6% by weight.

As other inorganic oxides added to the toner, it is suitable to use small-diameter inorganic oxides having a primary particle size of 40 nm or smaller for the purpose of controlling powder flowability and electrification, and further to use larger-diameter inorganic oxides for the purposes of reducing adherence and controlling electrification. These inorganic oxide particles may be any of known ones, but combined use of silica and titanium oxide is suitable for precision control of electrification. In addition, surface treatment given to small-diameter inorganic particles can enhance the ability of the particles to be dispersed and the effect of increasing the powder flowability. For the purpose of eliminating discharge products, it is also suitable to add carbonates such as calcium carbonate and magnesium carbonate, or inorganic minerals such as hydrotalcite.

Electrophotographic color toner is used in a state of being mixed with a carrier. Examples of the carrier usable herein include iron powder, glass beads, ferrite powder, nickel powder, and these metal powders surfaces of which are coated with resins. The mixing ratio between the toner and the carrier may be adjusted arbitrarily.

The cleaning device 27 is equipped with, e.g., a fibrous member 27*a* (having the form of a roll) and a cleaning blade (blade member) 27*b*.

Although the cleaning device 27 may have both a fibrous member 27*a* and a cleaning blade 27*b*, it may be a cleaning device having either of them. In addition to the shape of a roll, the shape of a toothbrush may be given to the fibrous member 27*a*. And the fibrous member 27*a* may be either fixed to the main body of a cleaning device, or supported in a state of being capable of rotating, or supported in a state of being capable of oscillating (vibrating) in the axial direction of the photoreceptor. Examples of the fibrous member 27*a* include a fabric woven to incorporate fibers of polyester, nylon, acrylic or the like, or fibers of very small diameter, such as Tracy (a product by TORAY INDUSTRIES, INC.), and a thing having the form of a brush implanted with resinous fibers, such as nylon, acrylic, polyolefin or polyester fibers, in the form of a matrix or a carpet. Further, the fibrous member 27*a* may be the foregoing members in which a conductive powder or an ionic conducting agent is mixed to impart conductivity thereto, or the foregoing members which each have a conductive layer formed in the interior or exterior of each individual constituent fiber. When the conductivity is imparted to the fibrous member, the resistance of a simple fiber is preferably controlled to a range of $10^2$ Ω to $10^9$ Ω. In addition, the thickness of fibers in the fibrous member 27*a* is preferably 30 d (denier) or below, far preferably 20 d or below, and the fiber density is preferably $2\times10^4$ lines/inch$^2$ or above, far preferably $3\times10^4$ lines/inch$^2$ or above.

The cleaning device 27 is required to eliminate extraneous matter (e.g., discharge products) on the photoreceptor surface by use of a cleaning blade, a cleaning brush or the like. For the purposes of meeting this requirement for the long term and stabilizing the function of the cleaning member, it is appropriate that a lubricating material (lubrication component), such as metallic soap, higher alcohol, wax or silicone oil, be supplied to the cleaning member.

For instance, in the case of using the fibrous member 27*a* having the form of a roll, it is preferred that the fibrous member be brought into contact with a lubricating substance, such as metallic soap or wax, and feed the lubrication component to the surface of the electrophotographic photoreceptor. As the cleaning blade 27*b*, a commonly-used rubber blade is used. When a rubber blade is used as the cleaning blade 27*b*, the feeding of a lubrication component to the electrophotographic photoreceptor surface is effective especially in preventing the blade from becoming chipped or wearing.

The process cartridge 20 illustrated above is designed to be freely detachable from the main body of an image forming apparatus, and makes up the image forming apparatus together with the main body of the image forming apparatus.

As the exposure device 30, any device will suffice as long as it allows light exposure of the charged electrophotographic photoreceptor 1 and formation of electrostatic latent images. And the light source used in the exposure device 30 is preferably an LED (light emitting diode) array, a scanning laser exposure source, a multi-beam plane emission laser or the like.

As the transfer device 40, any device will suffice as long as it can transfer toner images on the electrophotographic photoreceptor 1 to a transfer-receiving material (an intermediate transfer member 50), and a commonly-used transfer device having the form of, e.g., a roll can be used.

The material usable as the intermediate transfer member 50 is a material having the form of a belt (intermediate transfer belt), which is made from semiconductivity-imparted polyimide, polyamideimide, polycarbonate, polyarylate, polyester, rubber or like polymers. As the form of the intermediate transfer member 50, the form of a drum as well as a belt may be adopted. Incidentally, direct-transfer image forming apparatuses which each are provided with no intermediate transfer member are also available.

The transfer-receiving medium used herein has no particular restrictions so long as it is a medium which can receive transfer of toner images formed on the electrophotographic photoreceptor 1. For instance, when direct transfer of toner images is made from the photoelectric photoreceptor 1 to paper or the like, the paper or the like is the transfer-receiving medium. When the intermediate transfer member 50 is used, on the other hand, the intermediate transfer member is the transfer-receiving medium.

Figure 3:
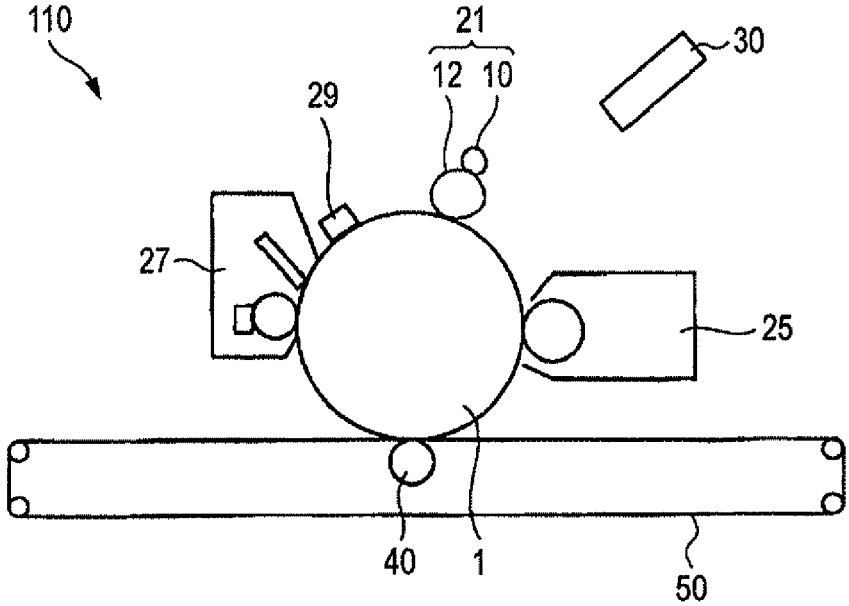
FIG. 3 is a schematic diagram illustrating another example of an image forming apparatus according to an exemplary embodiment of the invention.

FIG. 3 is a schematic diagram illustrating another example of the image forming apparatus according to an exemplary embodiment of the invention. In the image forming apparatus 110 shown in FIG. 3, an electrophotographic photoreceptor 1 is fixed to the main body of the image forming apparatus, while an electrostatic charging device 21, a developing device 25 and a cleaning device 27 are designed as their individual cartridges and loaded independently in the main body as a charging cartridge, a developing cartridge and a cleaning cartridge, respectively.

In the image forming apparatus 110, the electrophotographic photoreceptor 1 is isolated from each of the other devices, and each of the electrostatic charging device 21, the developing device 25 and the cleaning device 27 is attachable and detachable by such operations as to press into and draw from the main body without being fixed to the main body of the image forming apparatus with screws, or by swaging, bonding or welding.

When the electrophotographic photoreceptor used has high resistance to wear, there may be cases where it becomes unnecessary to design those devices in the cartridge form. In such cases, member costs per print can be reduced by designing each of the electrostatic charging device 21, the developing device 25 and the cleaning device 27 to be attachable and detachable by press-and-draw operations without being fixed to the main body with screws, or by swaging, bonding or welding. In addition, two or more of these devices can be integrated into one cartridge and rendered attachable and detachable, and thereby member costs can be further reduced.

By the way, the image forming apparatus 110 has the same makeup as the image forming apparatus 100 has, except that each of the electrostatic charging device 21, the developing device 25 and the cleaning device 27 is designed as a cartridge.

Figure 4:
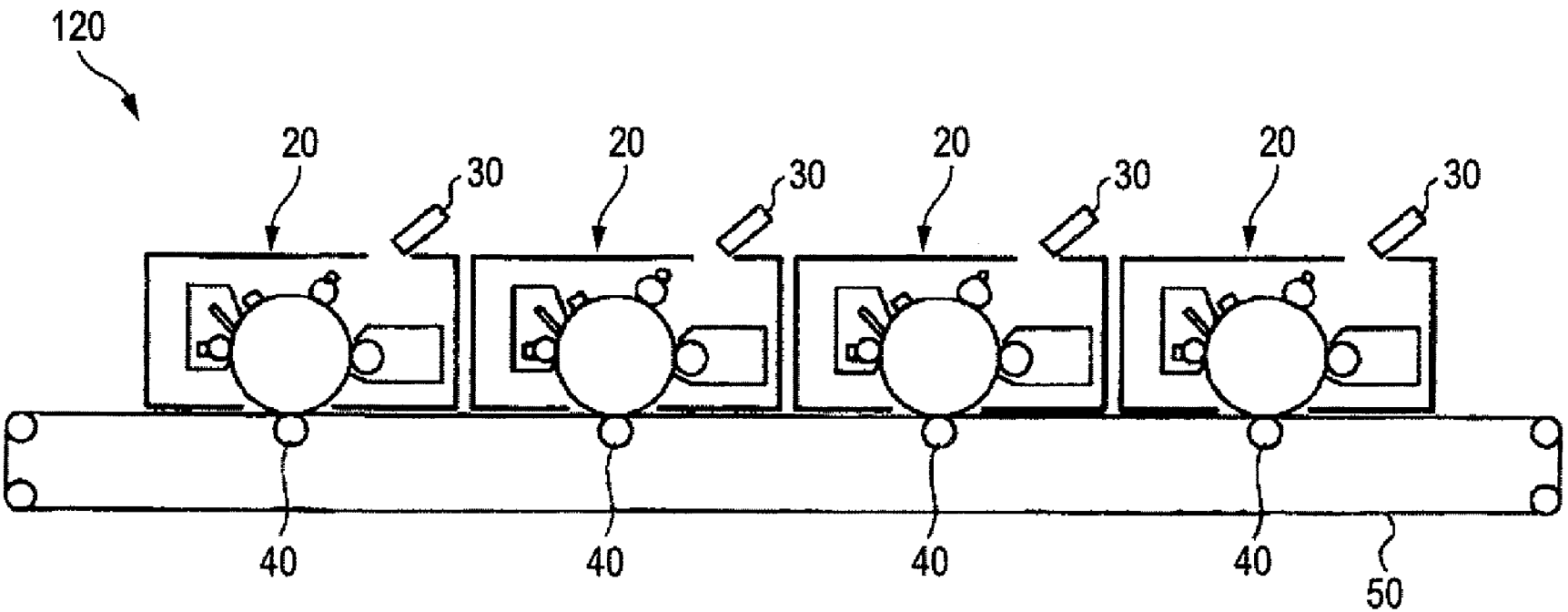
FIG. 4 is a schematic diagram illustrating still another example of an image forming apparatus according to an exemplary embodiment of the invention.

FIG. 4 is a schematic diagram illustrating still another example of the image forming apparatus according to an exemplary embodiment of the invention. The image forming apparatus 120 is a tandem-type full-color image forming apparatus equipped with four process cartridges 4. In the image forming apparatus 120, the four process cartridges 20 are juxtaposed to one another on the intermediate transfer member 50, and configured so as to use one electrophotographic photoreceptor per color. Additionally, the image forming apparatus 120 has the same makeup as the image forming apparatus 100 has, except that the tandem processing is performed.

Figure 5:
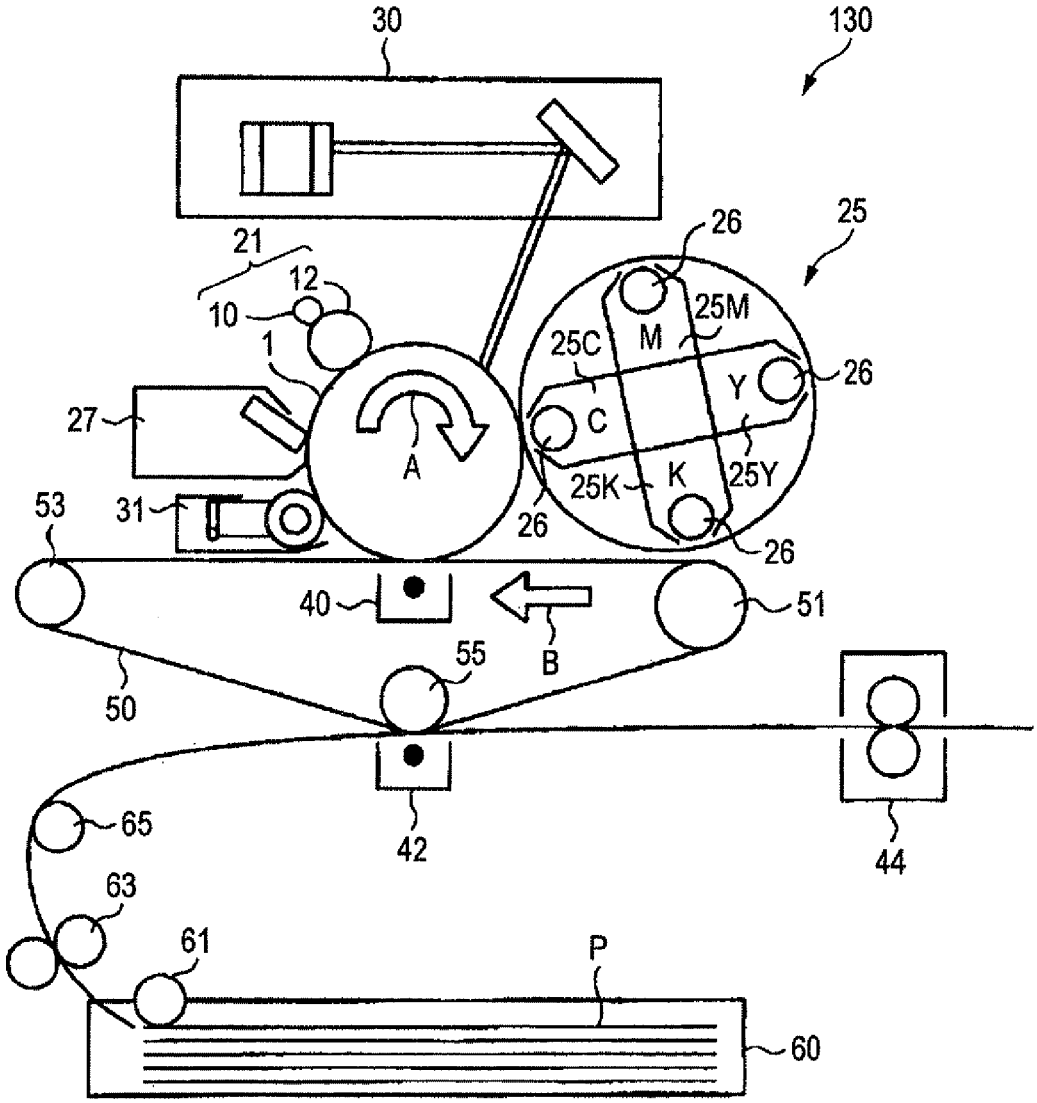
FIG. 5 is a schematic diagram illustrating a further example of an image forming apparatus according to an exemplary embodiment of the invention.

FIG. 5 is a schematic diagram illustrating a further example of the image forming apparatus according to an exemplary embodiment of the invention. The image forming apparatus 130 shown in FIG. 5 is an image forming apparatus of the so-called 4-cycle type which forms toner images of multiple colors by use of one electrophotographic photoreceptor. The image forming apparatus 130 is provided with a photoreceptor drum 1 which is made to rotate by a drive unit (not shown in the figure) at a predetermined rotation speed in the direction of the arrow A shown in the figure, and an electrostatic charging device 21 for electrostatic charging of the peripheral surface of the photoreceptor drum 1 is placed on the upper side of the photoreceptor drum 1.

In addition, an exposure device 30 equipped with a plane emission laser array as its exposure light source is placed above an electrostatic charging device 21. The exposure device 30 modulates a plurality of laser beams emitted from the light source according to images to be formed and, at the same time, polarizes the beams in the main scanning direction, and scans the peripheral surface of the photoreceptor drum 1 in directions substantially parallel with the axis of the photoreceptor drum 1. Thereby, electrostatic latent images are formed on the peripheral surface of the charged photoreceptor drum 1.

On a lateral side of the photoreceptor drum 1, a developing apparatus 25 is placed. The developing apparatus 25 has an enclosure in the shape of a roll, and is installed in a state of allowing rotation. In the interior of the enclosure, 4 accommodation spaces are formed, and developing units 25Y, 25M, 25C and 25K are installed in these accommodation spaces, respectively. The developing units 25Y, 25M, 25C and 25K are each equipped with a developing roll 26 independently, and store in the interior thereof yellow (Y) toner, magenta (M) toner, cyan (C) toner and black (K) toner, respectively.

In the image forming apparatus 130, full-color images are formed by carrying out image formation on the photoreceptor drum 1 at four times. More specifically, during the four-time image formation on the photoreceptor drum 1, the electrostatic charging device 21 repeats electrostatic charging of the peripheral surface of the photoreceptor drum 1 for every image formation on the photoreceptor drum 1, and the exposure device 30 repeats emission of a laser beam modulated according to any of image data on Y, M, C and K representing color images to be formed and scanning of the peripheral surface of the photoreceptor drum 1 as the image data used for modulation of laser beams is changed for every image formation on the photoreceptor drum 1. And every time a developing roll 26 in any of the developing units 25Y, 25M, 25C and 25K is moved to a position facing the peripheral surface of the photoreceptor drum 1, the developing apparatus 25 repeats steps of actuating the developing unit facing the peripheral surface of the photoreceptor drum 1 and developing an electrostatic latent image formed on the peripheral surface of the photoreceptor drum 1 to give a specified color thereto and form a toner image of the specified color on the peripheral surface of the photoreceptor drum 1 as the enclosure is rotated so that the developing unit used for development of the electrostatic latent image is changed for every formation of a different color image on the photoreceptor drum 1. By these operations, toner images of Y, M, C and K are formed in succession on the peripheral surface of the photoreceptor drum 1.

On the underside of the photoreceptor drum 1, an endless intermediate transfer belt 50 is further installed. The intermediate transfer belt 50 is looped over rolls 51, 53 and 55 in succession, and it is placed so that its outer surface comes into contact with the peripheral surface of the photoreceptor drum 1. The rolls 51, 53 and 55 are made to rotate by driving force transferred thereto from a motor (not shown in the figure) and revolve the intermediate transfer belt 50 in the direction of the arrow B shown in FIG. 5.

The transfer device (transfer instrument) 40 and the photoreceptor drum 1 are placed on opposite sides of the intermediate transfer belt 50, and toner images of Y, M, C and K formed in succession on the peripheral surface of the photoreceptor drum 1 are transferred only one color at a time to the image forming surface of the intermediate transfer belt 50 by means of the transfer device 40, and eventually images of Y, M, C and K are superposed on the intermediate transfer belt 50.

Further, on the side opposite to the developing device 25 side of the photoreceptor drum 1, a lubricant supplying device 31 and a cleaning device 27 are placed so as to come into contact with the peripheral surface of the photoreceptor drum 1. Upon transfer of toner image formed on the peripheral surface of the photoreceptor drum 1 to the intermediate transfer belt 50, a lubricant is supplied to the peripheral surface of the photoreceptor drum 1 from the lubricant supplying device 31 and the area having held the transferred toner image in the peripheral surface is cleaned with the cleaning device 27.

A paper tray 60 is disposed on the underside of the intermediate transfer belt 50, and two or more sheets of paper P as recording materials (transfer-receiving media) are accommodated in a state of stacking on the inside of the paper tray 60. At an upper left oblique position of the paper tray 60, a taking-out roll 61 is placed and, on the downstream side of the direction that paper P is taken out by the taking-out roll 61, a roll pair 63 and a roll 65 are disposed in order of mention. The recording paper at the new top of stack is taken out of the paper tray 60 by rotation of the taking-out roll 61 and conveyed by the roll pair 63 and the roll 65.

Furthermore, on the side opposite to the roll 55 side of the intermediate transfer belt 50, a transfer device 42 is placed. The paper P conveyed by the roll pair 63 and the roll 65 is fed between the intermediate transfer belt 50 and the transfer device 42, and the toner image formed on the image forming surface of the intermediate transfer belt 50 is transferred to the paper P by the transfer device 42. On the downstream side from the transfer device 42 in the conveying direction of paper P, a fixing device 44 equipped with a pair of fixing rolls is placed. After the toner image transferred to the paper P is melt and fixed by the fixing device 44, the transferred toner image-bearing paper P is ejected from the body of the image forming apparatus 130, and laid on a tray for receiving the ejected paper (not shown in the figure).

Additionally, the configurations of the process cartridge and the image forming apparatus according to exemplary embodiments of the invention are not limited to particular ones, but heretofore known configurations may be adopted.

EXAMPLES

The invention will now be illustrated in more detail by reference to the following examples and comparative examples, but these examples should not be construed as limiting the scope of the invention in any way.

<Making of Photoreceptor>

Preparation for a honing-treated cylindrical aluminum substrate having an outside diameter Φ of 30 mm is made first. Then, 100 parts by weight of a zirconium compound (ORGATIX ZC540, trade name, a product of Matsumoto Fine Chemical Co., Ltd.), 10 parts by weight of a silane compound (A1100, trade name, a product of Nippon Unicar Company Limited), 400 parts by weight of isopropanol and 200 parts by weight of butanol are mixed to prepare a coating solution for formation of a subbing layer. This coating solution is dip-coated on the aluminum substrate, and dried by heating at 150° C. for 10 minutes, thereby forming a subbing layer having a thickness of 0.1 μm.

In the next place, one parts by weight of hydroxygallium phthalocyanine having strong diffraction peaks at Bragg angles (2θ±0.2°) of 7.5°, 9.9°, 12.5°, 16.3°, 18.6°, 25.1° and 28.3° in its CuKα characteristic X-ray diffraction spectrum, one parts by weight of polyvinyl butyral (S-LEC BM-S, a product of SEKISUI CHEMICAL CO., LTD.) and 100 parts by weight of n-butyl acetate are mixed, and further subjected together with glass beads to one-hour dispersion treatment with a paint shaker, thereby preparing a coating solution for formation of a charge generating layer. This coating solution is dip-coated on the subbing layer, and dried by heating at 100° C. for 10 minutes to form a charge generating layer having a thickness of 0.15 μm.

Further, 2 parts by weight of the charge transporting material represented by the following formula (VI-1), 3 parts by weight of a high polymer having the structural units represented by the following formula (VI-2) (viscosity average molecular weight: 50,000) and 20 parts by weight of chlorobenzene are mixed to prepare a coating solution for formation of a charge transporting layer.

The thus prepared coating solution for charge transporting layer formation is dip-coated on the charge generating layer, and heated at 110° C. for 40 minutes, thereby forming a charge transporting layer having a thickness of 34 μm. Thus, a photoreceptor having on the honing-treated aluminum substrate the subbing layer, the charge generating layer and the charge transporting layer is obtained (which is designated as Photoreceptor 1).

Furthermore, 7 parts by weight of a resol-type phenol resin (PL-2211, a product of Gunei Chemical Industry Co., Ltd.) and 0.03 parts by weight of methylphenylpolysiloxane are prepared. And they are dissolved in 15 parts by weight of isopropanol and 5 parts by weight of methyl ethyl ketone. Thus, a coating solution for formation of a protective layer is obtained. This coating solution is dip-coated on Photoreceptor 1, and dried at 130° C. for 40 minutes, thereby forming a protective layer having a thickness of 3 μm. The photoreceptor thus obtained is designated as Photoreceptor 2.

<Making of Cleaning Member>

Urethane foam (Polyurethane EP70) as shown in Table 2 is cut, thereinto a core which is made of SUS303 and has an outside diameter ϕ of 5 mm and a length of 230 mm is inserted, the core and the urethane foam are bonded together with a hot-melt adhesive, and then two portions of the urethane foam, which range from both ends of the core to positions of 5 mm, respectively, are cut away, thereby forming an elastic roll material. This roll material is subjected to grinding treatment to make a cleaning roll (cleaning member a) which is used for an electrostatic charging member and has an outside diameter ϕ of 9 mm.

Another cleaning roll (cleaning member b) used for an electrostatic charging member is made in the same manner as described above, except that the urethane foam (polyurethane RSC) as shown in Table 2 is used.

Still another cleaning roll (cleaning member c) used for an electrostatic charging member is made in the same manner as described above, except that a non-foam material of the urethane (polyurethane EP70) as shown in Table 2 is used.

(VI-1)

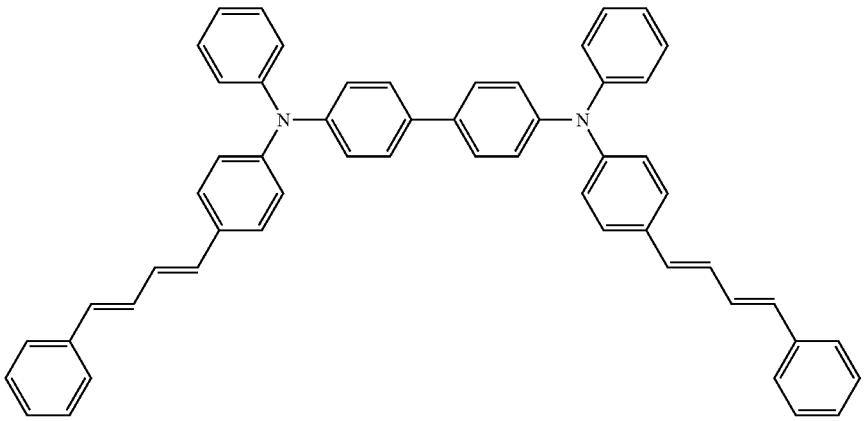

(VI-2)

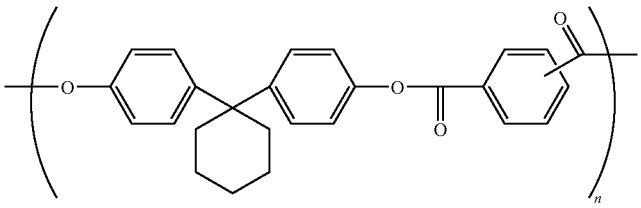

TABLE 2

| | Material | Shape | Cell diameter | Hardness | Product name | Manufacturer |
|---|---|---|---|---|---|---|
| Cleaning member a | Polyurethane | Column (roll) | 50 | 320N | EP70 | INOAC CORPORATION |
| Cleaning member b | Polyurethane | Column (roll) | 40 | 200N | RSC | INOAC CORPORATION |
| Cleaning member c | Non-foam material | Column (roll) | — | 500N | EP70 (Non-foam material) | INOAC CORPORATION |

Example 1

Making of Electrostatic Charging Roll

<Formation of Elastic Conducting Layer>

Each of mixtures having the compositions shown in Table 3 (the mixing ratios in Table 3 are by weight) is kneaded with an open roll, applied to the surface of a conductive support, which is made of SUS303 and has a diameter of 8 mm, via an adhesive layer, and formed into a roll having a diameter of 12.5 mm by means of a forming press. Subsequently, the rolls formed are each ground, and thereby provide elastic conducting rolls A and B having a diameter of 12 mm.

TABLE 3

| Composition of Ionic Conductor Layer | | | | |
|---|---|---|---|---|
| | | | Mixing Ratios | |
| | Ingredients | Chemical Species | A | B |
| Composition | Rubber | Epichlorohydrin rubber (Gechron 3106/ZEON CORPORATION) | 95.6 | 75 |
| | | Nitrile-butadiene rubber (N250S/JSR) | 4.4 | 25 |
| | Conductivity-imparting agent | Chlorobenzyltriethylammonium (KANTO CHEMICAL CO., INC.) | 0.9 | 0.9 |
| | | Carbon black (KETJENBLACK EC/LION CORPORATION) | 15 | 10 |
| | Vulcanizing agent | Sulfur (Sulfax PS/Tsurumi Chemical Industry) | 0.5 | 0.5 |
| | Vulcanization accelerator | Tetramethyllithium disulfide (NOCCELER TT/OUCHI SHINKO CHEMICAL INDUSTRIAL CO., LTD. | 1.5 | 1.5 |
| | | Dibenzothiazol disulfide (NOCCELER DM/OUCHISHINKO CHEMICAL INDUCTRIAL CO., LTD.) | 1.5 | 1.5 |
| | Filler | Calcium carbonate (Silver-W/SHIRAISHI KOGYO Kaisha, Ltd) | 20 | 20 |
| | Vulcanization accelerator | Stearic acid (KANTO CHEMICAL CO., INC.) | 1 | 1 |
| | | Zinc oxide (Fist-class zinc oxide/Seido Chemical Industry Co., Ltd.) | 5 | 5 |
| | | Thickness | 3 mm | 3 mm |

<Formation of Surface Layer>

A mixture of the composition shown for Example 1 in Table 4 (the mixing ratio in Table 4 is by weight) in an amount of 15 parts by weight is diluted with 85 parts by weight of methanol, and dispersed with a bead mill. The dispersion thus obtained is dip-coated on the surface of the elastic conducting roll A, and then subjected to crosslinking under heating at 140° C. for 30 minutes, and dried to form a 10 μm-thick surface layer. Thus, an electrostatic charging roll 1 is obtained.

<Measurement of Gel Fraction>

Gel fraction measurement is made on the surface layer in conformance with JIS K6796. A sample is prepared by cutting 1 parts by weight portion from the surface layer of the electrostatic charging roll 1, and the weight thereof is measured. The measured weight is taken as the weight of resin before solvent extraction. The sample is immersed in methanol (10 parts by weight) as a solvent at 25° C. for 24 hours, and then filtered. Thereby, a resinous filmy residue is separated and collected, and then the weight thereof is measured. This weight is taken as the weight after extraction. The gel fraction is calculated from the following relation.

$$\text{Gel fraction}(\%)=((\text{weight after solvent extraction})/(\text{weight of resin before solvent extraction}))\times 100$$

In addition, the crosslinking state is ascertained by performing GC-MS analysis as described below.

<Thermal Desorption System>

System: Double Shot Pyrolyzer PY-2010D (made by FRONTIER LABORATORIES LTD.)

Heating temperature: 180° C.

Interface temperature: 200° C.

<GC>

System: HP6890 GC System (made by Hewlett-Packard Company)

Column: Agilent 19091S-433 HP5MS (5% Phenylmethylsiloxane) (a product of Hewlett-Packard Company)

Split ratio: 1/50

Flow velocity: 1.0 mL/min

Temperature rise profile: 40° C. (3 min)→Temperature rise speed: 10° C./min→250° C. (5 min)

<MS>

System: 5973 Mass Selective Detector (made by Hewlett-Packard Company)

Ionization method: EI (Electron ionization)

Mass range: 50 to 800 m/z

Incidentally, the crosslinking-state analysis is conducted using as the reference *Shinpan Kobunshi Bunseki Handbook*, edited by Research Committee of Polymer Analysis of The Japan Society for Analytical Chemistry, published by Kinokuniya Company Ltd. in Jan. 12, 1995.

<Measurement of Surface Roughness Rz>

The surface roughness Rz (ten-point average surface roughness) of the surface layer is determined by the method defined by JIS B0601 (1994). As a measuring instrument, SURFCOM 1400 made by Tokyo Seimitsu Co., Ltd. is used. The measurement is carried out under conditions that the settings of cut-off, measuring length and traverse speed are 0.8 mm, 2.4 mm and 0.3 mm/sec, respectively.

<Ascertainment of Porous Filler>

The filler to be porous in the surface layer is ascertained by observing secondary electron images at an accelerating voltage of 5 kV under FE-SEM (JSM-6700F, made by JEOL LTD.). Results obtained are as follows.

Polyamide resin particles 1: average particle size 5.3 μm, pore diameter 0.5 μm, depth 0.1 μm Polyamide resin particles 2: average particle size 10.3 μm, pore diameter 1.0 μm, depth 0.3 μm Polyamide resin particles 3: average particle size 19.6 μm, pore diameter 1.2 μm, depth 0.6 μm Polyacrylic resin particles 1: average particle size 8 μm, pore diameter 0.013 μm, depth 0.003 μm Calcium carbonate particles 1: average particle size 15.0 μm, pore diameter 2 μm, depth 3 μm <<Evaluation of Electrostatic Charging Roll>>

On the electrostatic charging roll obtained in Example 1, retention of electrostatic charging capability and uniformity of electrostatic charging are evaluated. Results obtained are shown in Table 4.

<Retention of Electrostatic Charging Capability>

The electrostatic charging roll is loaded in a drum cartridge DocuCentre III C3300 and printing test is done using 50,000 sheets of A4-size paper (printing on 50,000 sheets of paper in a 10° C.-15% RH environment). Thereafter, 50% half tone image is printed with the DocuCentre III C3300, and distortion of the printed image is evaluated on the following criteria.

A: There is no distortion of printed image.

B: Although there is slight distortion of printed image, its extent is at a no-problem level.

C: Although there is a little distortion of printed image, its extent is at a no-problem level.

D: There are distorted spots in printed image.

E: Distortion appears in most part of printed image.

<Uniformity of Electrostatic Charging>

Uniformity of electrostatic charging is evaluated on the following criteria. The electrostatic charging roll is loaded in DocuCentre III C3300, and 50% half tone image is printed on A4-size paper in a 10° C.-15% RH environment. While the value of alternating current applied to the electrostatic charging device is changed (increased) stepwise from 1.0 mA, the value of alternating current at which image defects disappear is read.

A: Image defects disappear when the alternating-current value reaches 1.35 mA.

B: Image defects disappear when the alternating-current value reaches 1.4 mA.

C: Image defects disappear when the alternating-current value is increased beyond 1.5 mA.

Example 2

An electrostatic charging roll 2 is made in the same manner as in Example 1, except that TORESIN F30K (N-methoxymethylated nylon 6, weight-average molecular weight: $2.5\times10^4$, a product of Nagase ChemteX Corporation), which is an N-methoxymethylated nylon used as the prime component resin, is replaced with TORESIN EF30T (N-methoxymethylated nylon 6, weight-average molecular weight: $6\times10^4$, a product of Nagase ChemteX Corporation), and evaluated by the same methods as in Example 1. Results obtained are shown in Table 4.

Example 3

An electrostatic charging roll 3 is made in the same manner as in Example 1, except that the polyvinyl butyral resin (S-LEC BL-1, a product of SEKISUI CHEMICAL CO., LTD.) used as the second component resin is replaced with an epoxy resin (EP4000, a product of ADEKA CORPORATION), and evaluated by the same methods as in Example 1. Results obtained are shown in Table 4.

Example 4

An electrostatic charging roll 4 is made in the same manner as in Example 1, except that the polyvinyl butyral resin used as the second component resin is replaced with a polyester resin (VYLON SS30, a product of TOYOBO CO., LTD.), and evaluated by the same methods as in Example 1. Results obtained are shown in Table 4.

Example 5

An electrostatic charging roll 5 is made in the same manner as in Example 1, except that the polyvinyl butyral resin used as the second component resin is replaced with a melamine resin (MW30M, a product of Sanwa Chemical Co., Ltd.), and evaluated by the same methods as in Example 1. Results obtained are shown in Table 4.

Example 6

An electrostatic charging roll 6 is made in the same manner as in Example 1, except that the polyvinyl butyral resin used as the second component resin is replaced with a benzoguanamine resin (BL60, a product of Sanwa Chemical Co., Ltd.), and evaluated by the same methods as in Example 1. Results obtained are shown in Table 4.

Example 7

An electrostatic charging roll 7 is made in the same manner as in Example 1, except that the polyvinyl butyral resin used as the second component resin is replaced with a phenol resin (PL2211, a product of Gunei Chemical Industry Co., Ltd.), and evaluated by the same methods as in Example 1. Results obtained are shown in Table 4.

Example 8

Evaluations are made by the same methods as in Example 1, except that the cleaning roll for electrostatic charging member (cleaning member b) is used as the cleaning member instead of the cleaning roll for electrostatic charging member (cleaning member a). Results obtained are shown in Table 4.

Example 9

An electrostatic charging roll 8 is made in the same manner as in Example 1, except that the polyamide resin particles 2 (2001EXDNAT1, average particle size: 10.3 μm, pore diameter: 1.0 μm, depth: 0.3 μm, a product of Arkema) is used as the porous filler instead of the polyamide resin particles 1 (2001UDNAT1, average particle size: 5.3 μm, pore diameter: 0.5 μm, depth: 0.1 μm, a product of Arkema), and evaluated by the same methods as in Example 1. Results obtained are shown in Table 4.

Example 10

An electrostatic charging roll 9 is made in the same manner as in Example 1, except that the polyamide resin particles 3 (2002DNAT1, average particle size: 19.6 μm, pore diameter: 1.2 μm, depth: 0.6 μm, a product of Arkema) is used as the porous filler instead of the polyamide resin particles 1, and evaluated by the same methods as in Example 1. Results obtained are shown in Table 4.

Example 11

An electrostatic charging roll 10 is made in the same manner as in Example 1, except that the polyacrylic resin particles (MBP-8, average particle size: 8 μm, pore diameter: 0.013 μm, depth: 0.003 μm, a product of SEKISUI PLASTICS CO., LTD.) is used as the porous filler instead of the polyamide resin particles 1, and evaluated by the same methods as in Example 1. Results obtained are shown in Table 5.

Example 12

An electrostatic charging roll 11 is made in the same manner as in Example 1, except that the calcium carbonate particles (PS-15, average particle size: 15.0 μm, pore diameter: 2 μm, depth: 3 μm, a product of NEWLIME CO., LTD.) is used as the porous filler instead of the polyamide resin particles 1, and evaluated by the same methods as in Example 1. Results obtained are shown in Table 5.

Example 13

An electrostatic charging roll 12 is made in the same manner as in Example 1, except that NACURE 5225 (dodecylbenzenesulfonic acid dissociation, isopropanol solvent, pH 6.0-7.0, dissociation temperature 120° C., a product of King Industries Inc.) is used as the acid catalyst instead of NACURE 4167 (phosphoric acid dissociation, mixed isopropanol-isobutanol solvent, pH 6.8-7.3, dissociation temperature 80° C., a product of King Industries Inc.), and evaluated by the same methods as in Example 1. Results obtained are shown in Table 5.

Example 14

An electrostatic charging roll 13 is made in the same manner as in Example 1, except that sodium p-toluenesulfonate (a product of KANTO CHEMICAL CO., INC.) is used as the acid catalyst instead of NACURE 4167, and evaluated by the same methods as in Example 1. Results obtained are shown in Table 5.

Example 15

An electrostatic charging roll 14 is made in the same manner as in Example 1, except that citric acid (a product of KANTO CHEMICAL CO., INC.) is used as the acid catalyst instead of NACURE 4167, and evaluated by the same methods as in Example 1. Results obtained are shown in Table 5.

Example 16

An electrostatic charging roll 15 is made in the same manner as in Example 1, except that 10 parts by weight of tin oxide (SN-100P, a product of ISHIHARA SANGYO KAISHA LTD.) is used as the conductivity-imparting agent instead of 17 parts by weight of carbon black (MONARCH 1000, a product of Cabot Corporation), and evaluated by the same methods as in Example 1. Results obtained are shown in Table 5.

Example 17

Evaluations are made by the same methods as in Example 1, except that Photoreceptor 2 is used instead of Photoreceptor 1. Results obtained are shown in Table 5.

Example 18

Evaluations are made by the same methods as in Example 1, except that the elastic conducting roll B is used instead of the elastic conducting roll A. Results obtained are shown in Table 5.

Example 19

An electrostatic charging roll 16 is made in the same manner as in Example 1, except that a change in gel fraction is made by changing the baking condition to 5 minutes at 140° C., and evaluated by the same methods as in Example 1. Results obtained are shown in Table 5.

Example 20

An electrostatic charging roll 17 is made in the same manner as in Example 1, except that 5 parts by weight of a conducting polymer (Material name: Polyaniline W, a product of TA Chemical Co., Ltd.) is used as the conductivity-imparting agent instead of 17 parts by weight of the carbon black, and evaluated by the same methods as in Example 1. Results obtained are shown in Table 5.

Example 21

Evaluations are made by the same methods as in Example 1, except that the cleaning roll formed with a non-foam material for electrostatic charging member (cleaning member c) is used as the cleaning member instead of the cleaning roll for electrostatic charging member (cleaning member a). Results obtained are shown in Table 6.

Example 22

A mixture of the composition shown in the formulation columns for the surface layer of Example 22 in Table 6 (the mixing ratio in Table 6 is by weight) in an amount of 15 parts by weight is diluted with 85 parts by weight of methanol, and dispersed with a bead mill. The dispersion thus obtained is dip-coated on the surface of the elastic conducting roll A made in Example 1, and then subjected to crosslinking under heating at 140° C. for 30 minutes, and dried to form a 10 μm-thick surface layer. Thus, an electrostatic charging roll 18 is obtained. This roll is evaluated by the same methods as in Example 1. Results obtained are shown in Table 6.

Example 23

A mixture of the composition shown in the formulation columns for the surface layer of Example 23 in Table 6 (the mixing ratio in Table 6 is by weight) in an amount of 15 parts by weight is diluted with 85 parts by weight of methanol, and dispersed with a bead mill. The dispersion thus obtained is dip-coated on the surface of the elastic conducting roll A made in Example 1, and then subjected to crosslinking under heating at 140° C. for 30 minutes, and dried to form a 10 μm-thick surface layer. Thus, an electrostatic charging roll 19 is obtained. This roll is evaluated by the same methods as in Example 1. Results obtained are shown in Table 6.

Example 24

A mixture of the composition shown in the formulation columns for the surface layer of Example 24 in Table 6 (the mixing ratio in Table 6 is by weight) in an amount of 15 parts by weight is diluted with 85 parts by weight of methanol, and dispersed with a bead mill. The dispersion thus obtained is dip-coated on the surface of the elastic conducting roll A made in Example 1, and then subjected to crosslinking under heating at 140° C. for 30 minutes, and dried to form a 10 μm-thick surface layer. Thus, an electrostatic charging roll 20 is obtained. This roll is evaluated by the same methods as in Example 1. Results obtained are shown in Table 6.

Example 25

A mixture of the composition shown in the formulation columns for the surface layer of Example 25 in Table 6 (the mixing ratio in Table 6 is by weight) in an amount of 15 parts by weight is diluted with 85 parts by weight of methanol, and dispersed with a bead mill. The dispersion thus obtained is dip-coated on the surface of the elastic conducting roll A made in Example 1, and then subjected to crosslinking under heating at 140° C. for 30 minutes, and dried to form a 10 μm-thick surface layer. Thus, an electrostatic charging roll 21 is obtained. This roll is evaluated by the same methods as in Example 1. Results obtained are shown in Table 6.

Example 26

A mixture of the composition shown in the formulation columns for the surface layer of Example 26 in Table 6 (the mixing ratio in Table 6 is by weight) in an amount of 15 parts by weight is diluted with 85 parts by weight of methanol, and dispersed with a bead mill. The dispersion thus obtained is dip-coated on the surface of the elastic conducting roll A made in Example 1, and then subjected to crosslinking under heating at 140° C. for 30 minutes, and dried to form a 10 μm-thick surface layer. Thus, an electrostatic charging roll 22 is obtained. This roll is evaluated by the same methods as in Example 1. Results obtained are shown in Table 6.

Example 27

A mixture of the composition shown in the formulation columns for the surface layer of Example 27 in Table 6 (the mixing ratio in Table 6 is by weight) in an amount of 15 parts by weight is diluted with 85 parts by weight of methanol, and dispersed with a bead mill. The dispersion thus obtained is dip-coated on the surface of the elastic conducting roll A made in Example 1, and then subjected to crosslinking under heating at 140° C. for 30 minutes, and dried to form a 10 μm-thick surface layer. Thus, an electrostatic charging roll 23 is obtained. This roll is evaluated by the same methods as in Example 1. Results obtained are shown in Table 6.

Comparative Example 1

An electrostatic charging roll 24 is made in the same manner as in Example 3, except that a change in gel fraction is made by changing the baking condition to 10 minutes at 100° C., and evaluated by the same methods as in Example 3. Results obtained are shown in Table 7.

Comparative Example 2

An electrostatic charging roll 25 is made in the same manner as in Example 1, except that non-porous polystyrene resin particles (SBX-6, a product of SEKISUI PLASTICS CO., LTD.) is used as the filler instead of the polyamide resin particles 1, and evaluated by the same methods as in Example 1. Results obtained are shown in Table 7.

Comparative Example 3

An electrostatic charging roll 26 is made in the same manner as in Example 1, except that a change in gel fraction is made by changing the baking condition to 10 minutes at 130° C., and evaluated by the same methods as in Example 1. Results obtained are shown in Table 7.

Comparative Example 4

An electrostatic charging roll 27 is made in the same manner as in Example 1, except that no porous filler is added, and evaluated by the same methods as in Example 1. Results obtained are shown in Table 7.

Comparative Example 5

A mixture of the composition shown in the formulation columns for the surface layer of Comparative Example 5 in Table 7 (the mixing ratio in Table 7 is by weight) in an amount of 15 parts by weight is diluted with 85 parts by weight of methanol, and dispersed with a bead mill. The dispersion thus obtained is dip-coated on the surface of the elastic conducting roll A made in Example 1, and then subjected to crosslinking under heating at 140° C. for 30 minutes, and dried to form a 10 μm-thick surface layer. Thus, an electrostatic charging roll 28 is obtained. This roll is evaluated by the same methods as in Example 1. Results obtained are shown in Table 7.

Comparative Example 6

A mixture of the composition shown in the formulation columns for the surface layer of Comparative Example 6 in Table 7 (the mixing ratio in Table 7 is by weight) in an amount of 15 parts by weight is diluted with 85 parts by weight of methanol, and dispersed with a bead mill. The dispersion thus obtained is dip-coated on the surface of the elastic conducting roll A made in Example 1, and then subjected to crosslinking under heating at 140° C. for 30 minutes, and dried to form a 10 μm-thick surface layer. Thus, an electrostatic charging roll 29 is obtained. This roll is evaluated by the same methods as in Example 1. Results obtained are shown in Table 7.

Additionally, the ingredients used in each of Examples and Comparative Examples are those as shown in Table 8.

TABLE 4

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| | Photoreceptor | | 1 | 1 | 1 | 1 | 1 | 1 | 1 | 1 | 1 | 1 |
| | Elastic Conducting roll | | A | A | A | A | A | A | A | A | A | A |
| | Cleaning member | | a | a | a | a | a | a | a | b | a | a |
| | Shape of cleaning member | | roll | roll | roll | roll | roll | roll | roll | roll | roll | roll |
| Formulation | Prime resin | EF30T[2)] | — | 100 | — | — | — | — | — | — | — | — |
| | | F30K[3)] | 100 | — | 100 | 100 | 100 | 100 | 100 | 100 | 100 | 100 |
| | | A-801P (acrylic resin) | — | — | — | — | — | — | — | — | — | — |
| | Second resin | Polyvinyl butyral resin | 10 | 10 | — | — | — | — | — | 10 | 10 | 10 |
| | | Epoxy resin | — | — | 10 | — | — | — | — | — | — | — |
| | | Polyester resin | — | — | — | 10 | — | — | — | — | — | — |
| | | Melamine resin | — | — | — | — | 10 | — | — | — | — | — |
| | | Benzoguanamine resin | — | — | — | — | — | 10 | — | — | — | — |
| | | Phenol resin | — | — | — | — | — | — | 10 | — | — | — |
| | Additive[1)] | Carbon black | 17 | 17 | 17 | 17 | 17 | 17 | 17 | 17 | 17 | 17 |
| | | Tin oxide | — | — | — | — | — | — | — | — | — | — |
| | | Conducting polymer | — | — | — | — | — | — | — | — | — | — |
| | Porous filler | Polyamide resin particles 1 | 33 | 33 | 33 | 33 | 33 | 33 | 33 | 33 | — | — |
| | | Polyamide resin particles 2 | — | — | — | — | — | — | — | — | 33 | — |
| | | Polyamide resin particles 3 | — | — | — | — | — | — | — | — | — | 33 |
| | | Polyacrylic resin particles 1 | — | — | — | — | — | — | — | — | — | — |
| | | Calcium carbonate particles 1 | — | — | — | — | — | — | — | — | — | — |
| | Filler | Polystyrene resin particles | — | — | — | — | — | — | — | — | — | — |
| | Catalyst | NACURE 4167 | 4.4 | 4.4 | 4.4 | 4.4 | 4.4 | 4.4 | 4.4 | 4.4 | 4.4 | 4.4 |
| | | NACURE 5225 | — | — | — | — | — | — | — | — | — | — |
| | | Sodium p-toluenesulfonate | — | — | — | — | — | — | — | — | — | — |
| | | Citric acid | — | — | — | — | — | — | — | — | — | — |
| | Gel fraction [%] | | 96 | 98 | 90 | 88 | 94 | 94 | 87 | 90 | 94 | 99 |
| | Surface roughness Rz [μm] | | 9 | 10 | 9 | 9 | 11 | 8 | 10 | 11 | 12 | 17 |
| | Retention of electrostatic charging capability | | A | A | B | B | B | B | B | A | A | B |
| | Uniformity of electrostatic charging | | A | A | A | A | A | A | A | A | A | A |

[1)]Conductivity imparting agent,
[2)]N-methoxymethylated nylon,
[3)]N-methoxymethylated nylon

TABLE 5

| | | | Example | | | | | | | | | |
|---|---|---|---|---|---|---|---|---|---|---|---|---|
| | | | 11 | 12 | 13 | 14 | 15 | 16 | 17 | 18 | 19 | 20 |
| | Photoreceptor | | 1 | 1 | 1 | 1 | 1 | 1 | 2 | 1 | 1 | 1 |
| | Elastic Conducting roll | | A | A | A | A | A | A | A | B | A | A |
| | Cleaning member | | a | a | a | a | a | a | a | a | a | a |
| | Shape of cleaning member | | roll | roll | roll | roll | roll | roll | roll | roll | roll | roll |
| Formulation | Prime resin | EF30T[2)] | — | — | — | — | — | — | — | — | — | — |
| | | F30K[3)] | 100 | 100 | 100 | 100 | 100 | 100 | 100 | 100 | 100 | 100 |
| | | A-801P (acrylic resin) | — | — | — | — | — | — | — | — | — | — |
| | Second resin | Polyvinyl butyral resin | 10 | 10 | 10 | 10 | 10 | 10 | 10 | 10 | 10 | 10 |
| | | Epoxy resin | — | — | — | — | — | — | — | — | — | — |
| | | Polyester resin | — | — | — | — | — | — | — | — | — | — |
| | | Melamine resin | — | — | — | — | — | — | — | — | — | — |
| | | Benzoguanamine resin | — | — | — | — | — | — | — | — | — | — |
| | | Phenol resin | — | — | — | — | — | — | — | — | — | — |
| | | Isocyanate resin | — | — | — | — | — | — | — | — | — | — |
| | Additive[1)] | Carbon black | 17 | 17 | 17 | 17 | 17 | — | 17 | 17 | 17 | — |
| | | Tin oxide | — | — | — | — | — | 10 | — | — | — | — |
| | | Conducting polymer | — | — | — | — | — | — | — | — | — | 5 |
| | Porous filler | Polyamide resin particles 1 | — | — | 33 | 33 | 33 | 33 | 33 | 33 | 33 | 33 |
| | | Polyamide resin particles 2 | — | — | — | — | — | — | — | — | — | — |
| | | Polyamide resin particles 3 | — | — | — | — | — | — | — | — | — | — |
| | | Polyacrylic resin particles 1 | 33 | — | — | — | — | — | — | — | — | — |
| | | Calcium carbonate particles 1 | — | 33 | — | — | — | — | — | — | — | — |
| | Filler | Polystyrene resin particles | — | — | — | — | — | — | — | — | — | — |
| | Catalyst | NACURE 4167 | 4.4 | 4.4 | — | — | — | 4.4 | 4.4 | 4.4 | 4.4 | 4.4 |
| | | NACURE 5225 | — | — | 4.4 | — | — | — | — | — | — | — |
| | | Sodium p-toluenesulfonate | — | — | — | 1.1 | — | — | — | — | — | — |
| | | Citric acid | — | — | — | — | 1.1 | — | — | — | — | — |
| | Gel fraction [%] | | 95 | 94 | 99 | 99 | 74 | 89 | 90 | 90 | 53 | 93 |

TABLE 5-continued

| | Example | | | | | | | | | |
|---|---|---|---|---|---|---|---|---|---|---|
| | 11 | 12 | 13 | 14 | 15 | 16 | 17 | 18 | 19 | 20 |
| Surface roughness Rz [μm] | 5 | 15 | 10 | 9 | 9 | 10 | 10 | 9 | 10 | 9 |
| Retention of electrostatic charging capability | C | B | B | B | B | B | A | A | C | B |
| Uniformity of electrostatic charging | B | A | A | A | A | A | A | A | A | A |

1)Conductivity imparting agent,
2)N-methoxymethylated nylon,
3)N-methoxymethylated nylon

TABLE 6

| | | | Example | | | | | | |
|---|---|---|---|---|---|---|---|---|---|
| | | | 21 | 22 | 23 | 24 | 25 | 26 | 27 |
| | Photoreceptor | | 1 | 1 | 1 | 1 | 1 | 1 | 1 |
| | Elastic conducting roll | | A | A | A | A | A | A | A |
| | Cleaning member | | c | a | a | a | a | a | a |
| | Shape of cleaning member | | roll | roll | roll | roll | roll | roll | roll |
| Formulation | Prime resin | EF30T (N-methoxymethylated nylon) | — | — | — | — | — | — | — |
| | | F30K (N-methoxymethylated nylon) | 100 | 100 | — | 100 | 100 | 100 | 100 |
| | | A801P (acrylic resin) | — | — | 100 | — | — | — | — |
| | Second resin | Polyvinyl butyral resin | 10 | — | — | 10 | 50 | 10 | 10 |
| | | Epoxy resin | — | — | — | — | — | — | — |
| | | Polyester resin | — | — | — | — | — | — | — |
| | | Melamine resin | — | — | — | — | — | — | — |
| | | Benzoguanamine resin | — | — | — | — | — | — | — |
| | | Phenol resin | — | — | — | — | — | — | — |
| | | Isocyanate resin | — | — | 10 | — | — | — | — |
| | Conductivity imparting agent | Carbon black | 17 | 15 | 17 | — | 23 | 17 | 17 |
| | | Tin oxide | — | — | — | — | — | — | — |
| | | Conducting polymer | — | — | — | — | — | — | — |
| | Porous filler | Polyamide resin particles 1 | 33 | 30 | 33 | 30 | 45 | — | 6 |
| | | Polyamide resin particles 2 | — | — | — | — | — | — | — |
| | | Polyamide resin particles 3 | — | — | — | — | — | 45 | — |
| | | Polyacrylic resin particles 1 | — | — | — | — | — | — | — |
| | | Calcium carbonate particles 1 | — | — | — | — | — | — | — |
| | Filler | Polystyrene resin particles | — | — | — | — | — | — | — |
| | Catalyst | NACURE 4167 | 4.4 | 4 | 4.4 | 4.4 | 6 | 4.4 | 6 |
| | | NACURE 5225 | — | — | — | — | — | — | — |
| | | Sodium p-toluenesulfonate | — | — | — | — | — | — | — |
| | | Citric acid | — | — | — | — | — | — | — |
| | Gel fraction [%] | | 99 | 99 | 95 | 92 | 92 | 99 | 99 |
| | Surface roughness Rz [μm] | | 9 | 13 | 11 | 10 | 9 | 19 | 3 |
| | Retention of electrostatic charging capability | | B | B | B | A | A | C | C |
| | Uniformity of electrostatic charging | | A | B | B | B | A | A | C |

TABLE 7

| | | | Comparative Example | | | | | |
|---|---|---|---|---|---|---|---|---|
| | | | 1 | 2 | 3 | 4 | 5 | 6 |
| | Photoreceptor | | 1 | 1 | 1 | 1 | 1 | 1 |
| | Elastic conducting roll | | A | A | A | A | A | A |
| | Cleaning member | | a | a | a | a | a | a |
| | Shape of cleaning member | | roll | roll | roll | roll | roll | roll |
| Formulation | Prime resin | EF30T (N-methoxymethylated nylon) | — | — | — | — | — | — |
| | | F30K (N-methoxymethylated nylon) | 100 | 100 | 100 | 100 | 100 | 100 |
| | | A801P (acrylic resin) | — | — | — | — | — | — |
| | Second resin | Polyvinyl butyral resin | 10 | 10 | 10 | 10 | 10 | 10 |
| | | Epoxy resin | — | — | — | — | — | — |
| | | Polyester resin | — | — | — | — | — | — |
| | | Melamine resin | — | — | — | — | — | — |
| | | Benzoguanamine resin | — | — | — | — | — | — |
| | | Phenol resin | — | — | — | — | — | — |
| | | Isocyanate resin | — | — | — | — | — | — |
| | Conductivity imparting agent | Carbon black | 17 | 17 | 17 | 17 | 17 | 17 |
| | | Tin oxide | — | — | — | — | — | — |
| | | Conducting polymer | — | — | — | — | — | — |
| | Porous filler | Polyamide resin particles 1 | 33 | — | 33 | — | — | 3 |
| | | Polyamide resin particles 2 | — | — | — | — | — | — |
| | | Polyamide resin particles 3 | — | — | — | — | 75 | — |

TABLE 7-continued

| | | Comparative Example | | | | | |
|---|---|---|---|---|---|---|---|
| | | 1 | 2 | 3 | 4 | 5 | 6 |
| | Polyacrylic resin particles 1 | — | — | — | — | — | — |
| | Calcium carbonate particles 1 | — | — | — | — | — | — |
| Filler | Polystyrene resin particles | — | 33 | — | — | — | — |
| Catalyst | NACURE 4167 | 4.4 | 4.4 | 4.4 | 4.4 | 4.4 | 5.4 |
| | NACURE 5225 | — | — | — | — | — | — |
| | Sodium p-toluenesulfonate | — | — | — | — | — | — |
| | Citric acid | — | — | — | — | — | — |
| Gel fraction [%] | | 34 | 96 | 48 | 98 | 99 | 99 |
| Surface roughness Rz [μm] | | 10 | 10 | 9 | 1 | 22 | 1.8 |
| Retention of electrostatic charging capability | | D | E | D | E | E | E |
| Uniformity of electrostatic charging | | A | A | A | C | A | C |

TABLE 8

| | | Ingredient | Product number | Manufacturer |
|---|---|---|---|---|
| Formulation | Prime resin | N-methoxymethylated nylon 1 | TORESIN EF-30T | Nagase Chemtex Corporation |
| | | N-methoxymethylated nylon 2 | TORESIN F30K | Nagase Chemtex Corporation |
| | Second resin | Polyvinyl butyral resin | S-LEC BL-1 | SEKISUI CHEMICAL CO., LTD. |
| | | Epoxy resin | ADEKA RESIN EP-4000 | ADEKA CORPORATION |
| | | Polyester resin | VYLON SS30 | TOYOBO CO., LTD. |
| | | Melamine resin | NIKALAC MW-30M | Sanwa Chemical Co., Ltd. |
| | | Benzoguanamine resin | NIKALAC BL-60 | Sanwa Chemical Co., Ltd. |
| | | Phenol resin | RESITOP PL-2211 | Gunei Chemical Industry Co., Ltd. |
| | | Isocyanate resin | BL-3175 | Sumika Bayer Urethane Co., Ltd. |
| | Conductivity imparting agent | Carbon black | MONARCH 1000 | Cabot Corporation |
| | | Tin oxide | SN-100P | ISHIHARA SNAGYO KAISHA LTD. |
| | | Conducting polymer | Polyaniline (W) | TA Chemical Co., Ltd. |
| | Porous filler | Polyamide resin particles 1 | 2001UDNAT1 | Arkema |
| | | Polyamide resin particles 2 | 2001EXDNAT1 | Arkema |
| | | Polyamide resin particles 3 | 2002DNAT1 | Arkema |
| | | Polyacrylic resin particles 1 | MBP-8 | SEKISUI PLASTICS CO., LTD. |
| | | Calcium carbonate particles 1 | PS-15 | NEWLIME CO., LTD. |
| | Filler | Polystyrene resin particles | SBX-6 | SEKISUI PLASTICS CO., LTD. |
| | Catalyst | Acid catalyst 1 | NACURE 4167 | King Industries Inc. |
| | | Acid catalyst 2 | NACURE 5225 | King Industries Inc. |
| | | Acid catalyst 3 | Sodium p-toluenesulfonate | KANTO CHEMICAL CO., INC. |
| | | Acid catalyst 4 | Citric acid | KANTO CHEMICAL CO., INC. |

As can be seen from Tables 4 to 7, the electrostatic charging rolls of Examples 1 to 27 are superior in both uniformity of electrostatic charging and retention of electrostatic charging capability, and allow long-term use.

What is claimed is:

1. An electrostatic charging member comprising:

a base material; and an outermost layer that contains a porous filler and a resin and has a gel fraction of at least about 50% and a surface roughness Rz in a range of about 2 μm to about 20 μm, wherein the porous filler is a polyamide resin.

2. The electrostatic charging member as described in claim 1, wherein the outermost layer contains a polyamide resin as a prime component and further contains at least one selected from the group consisting of a polyvinyl acetal resin, a polyester resin, a phenol resin, an epoxy resin, a melamine resin and a benzoguanamine resin.

3. The electrostatic charging member as described in claim 2, wherein the polyamide resin is an alcohol-soluble polyamide resin.

4. The electrostatic charging member as described in claim 3, wherein the alcohol-soluble polyamide resin is an N-alkoxymethylated nylon.

5. The electrostatic charging member as described in claim 4, wherein the N-alkoxymethylated nylon is an N-methoxymethylated nylon.

6. The electrostatic charging member as described in claim 1, wherein the outermost layer is a layer formed by crosslinking reaction using a thermally-latent acid catalyst.

7. An electrostatic charging device comprising:

an electrostatic charging member that comprises:

a base material, and an outermost layer that contains a porous filler and a resin and has a gel fraction of at least about 50% and a surface roughness Rz in a range of about 2 μm to about 20 μm, wherein the porous filler is a polyamide resin.

8. The electrostatic charging device as described in claim 7, further comprising:

a cleaning member that cleans a surface of the electrostatic charging member.

9. The electrostatic charging device as described in claim 8, wherein the cleaning member comprises an elastic layer containing a foam material.

10. A process cartridge comprising:

an image holding member; and an electrostatic charging member that electrostatically charges the image holding member, and comprises:

a base material, and an outermost layer that contains a porous filler and a resin and has a gel fraction of at least about 50% and a surface roughness Rz in a range of about 2 μm to about 20 μm, wherein the porous filler is a polyamide resin.

11. The process cartridge as described in claim 10, further comprising:

a cleaning member that cleans a surface of the electrostatic charging member.

12. The process cartridge as described in claim 11, wherein the cleaning member comprises an elastic layer containing a foam material.

13. An image forming apparatus comprising:

an image holding member;

an electrostatic charging member that electrostatically charges the image holding member, and comprises:

a base material, and an outermost layer that contains a porous filler and a resin and has a gel fraction of at least about 50% and a surface roughness Rz in a range of about 2 μm to about 20 μm;

a latent-image forming unit that forms a latent image on a surface of the image holding member; and a developing unit that develops the latent image formed on the surface of the image holding member with a toner to form a toner image, wherein the porous filler is a polyamide resin.

14. The image forming apparatus as described in claim 13, further comprising:

a cleaning member that cleans a surface of the electrostatic charging member.

15. The image forming apparatus as described in claim 14, wherein the cleaning member comprises an elastic layer containing a foam material.

* * * * *